US010646769B1

(12) United States Patent
Farris et al.

(10) Patent No.: US 10,646,769 B1
(45) Date of Patent: May 12, 2020

(54) DISCRETE SHOULDER SLEEVE FOR A SHOULDER-PAD SYSTEM

(71) Applicant: NIKE, Inc., Beaverton, OR (US)

(72) Inventors: Bryan N. Farris, North Plains, OR (US); David Turner, Portland, OR (US)

(73) Assignee: NIKE, INC., Beaverton, OR (US)

( * ) Notice: Subject to any disclaimer, the term of this patent is extended or adjusted under 35 U.S.C. 154(b) by 420 days.

(21) Appl. No.: 15/481,146

(22) Filed: Apr. 6, 2017

Related U.S. Application Data

(60) Provisional application No. 62/319,664, filed on Apr. 7, 2016, provisional application No. 62/319,662, filed on Apr. 7, 2016, provisional application No. 62/319,660, filed on Apr. 7, 2016.

(51) Int. Cl.
*A41D 13/00* (2006.01)
*A63B 71/12* (2006.01)

(52) U.S. Cl.
CPC ..... *A63B 71/12* (2013.01); *A41D 13/0015* (2013.01); *A63B 2071/1208* (2013.01)

(58) Field of Classification Search
CPC ..... A63B 2071/1208; A63B 71/12; A41D 13/0015
See application file for complete search history.

(56) References Cited

U.S. PATENT DOCUMENTS 1,310,477 A 7/1919 Thomas
2,545,039 A 3/1951 Mitchel
2,902,695 A * 9/1959 Werner ..... A41D 27/26 2/268
3,064,265 A 11/1962 Bridgewaters et al.
3,452,362 A 7/1969 Korolick et al.
3,561,009 A 2/1971 Huggins
3,740,763 A 6/1973 Mitchell
3,866,241 A 2/1975 Grant
3,867,726 A 2/1975 Owl et al.
(Continued)

FOREIGN PATENT DOCUMENTS

CA 2822264 A1 8/2008
CA 2841674 A1 7/2015
(Continued)

OTHER PUBLICATIONS

"Neoprene shoulder support brace compression effective shoulder guard," Alibaba®, wholesaler.alibaba.com, accessed: Dec. 2015. http://wholesaler.alibaba.com/product-detail/Neoprene-shoulder-support-bracebelt-unisex_60340437466.html?spm=a2700.7724857.29.82.JdFwmm, 8 pages.
(Continued)

*Primary Examiner* — Anna K Kinsaul
(74) *Attorney, Agent, or Firm* — Shook, Hardy & Bacon, LLP

(57) ABSTRACT

A shoulder-pad system includes various components, including a set of shoulder pads that comprises a right-shoulder pad assembly, a left-shoulder pad assembly, an anterior plate, and a posterior plate. Each shoulder-pad assembly may include an epaulette and a discrete shoulder sleeve that is releasably attachable to the epaulette. The discrete shoulder sleeve may further include an epaulette attachment mechanism that releasable attaches the discrete shoulder sleeve to the epaulette when the epaulette is positioned within the cavity.

20 Claims, 13 Drawing Sheets

(56) References Cited

U.S. PATENT DOCUMENTS

| | | | |
|---|---|---|---|
| 3,981,027 | A | 9/1976 | Anderson |
| 4,320,537 | A | 3/1982 | Mitchell |
| 4,467,475 | A | 8/1984 | Gregory et al. |
| 4,554,681 | A | 11/1985 | Kirkland |
| 4,590,622 | A | 5/1986 | Wolfe et al. |
| 4,698,849 | A | 10/1987 | Mitchell et al. |
| 4,868,925 | A | 9/1989 | Mitchell |
| 4,987,610 | A | 1/1991 | Hunt |
| 5,020,156 | A | 6/1991 | Neuhalfen |
| 5,054,121 | A | 10/1991 | Mitchell |
| 5,065,457 | A | 11/1991 | Henson |
| 5,173,964 | A | 12/1992 | Ball |
| 5,187,812 | A | 2/1993 | Neuhalfen |
| 5,245,706 | A | 9/1993 | Moschetti |
| 5,319,806 | A | 6/1994 | Hermann |
| 5,349,704 | A | 9/1994 | Masters |
| 5,390,368 | A | 2/1995 | Chang |
| 5,403,268 | A | 4/1995 | Clement |
| 5,530,966 | A | 7/1996 | West |
| 5,623,728 | A | 4/1997 | Wagner |
| 5,742,939 | A | 4/1998 | Williams |
| 5,754,982 | A | 5/1998 | Gainer |
| 6,021,528 | A | 2/2000 | Jurga et al. |
| 6,060,408 | A | 5/2000 | Monica |
| 6,079,056 | A | 6/2000 | Fogelberg |
| 6,088,831 | A | 7/2000 | Jensen et al. |
| 6,202,214 | B1 | 3/2001 | Light |
| 6,247,188 | B1 | 6/2001 | Beland |
| 6,260,196 | B1 | 7/2001 | van der Sleesen |
| 6,389,600 | B1 | 5/2002 | Di Maio |
| 6,484,325 | B1 | 11/2002 | Lazarus et al. |
| 6,510,559 | B1 | 1/2003 | Linares |
| 6,553,579 | B1 | 4/2003 | Gillen et al. |
| 6,709,411 | B1 | 3/2004 | Olinger |
| 6,845,522 | B2 | 1/2005 | Beland |
| 6,880,347 | B1 | 4/2005 | Stam |
| 7,854,026 | B2 | 12/2010 | Phaneuf et al. |
| 7,871,388 | B2 | 1/2011 | Brown |
| 7,882,576 | B2 | 2/2011 | Morrow et al. |
| 8,015,621 | B2 | 9/2011 | Udelhofen |
| 8,082,602 | B2 | 12/2011 | Crelinsten et al. |
| 8,221,291 | B1 | 7/2012 | Kantarevic |
| 8,336,124 | B2 | 12/2012 | Crelinsten et al. |
| 8,533,871 | B2 | 9/2013 | Fiegener et al. |
| 8,818,478 | B2 | 8/2014 | Scheffler et al. |
| 8,850,613 | B2 | 10/2014 | Kordecki |
| 8,869,315 | B2 | 10/2014 | Contant et al. |
| 8,869,316 | B2 | 10/2014 | Lewis |
| 2004/0003448 | A1 | 1/2004 | Morrow et al. |
| 2004/0210992 | A1 | 10/2004 | Morrow et al. |
| 2005/0102741 | A1 | 5/2005 | McQueer |
| 2006/0048292 | A1 | 3/2006 | Gillen et al. |
| 2006/0053535 | A1 | 3/2006 | Ide et al. |
| 2007/0050886 | A1 | 3/2007 | Brassill |
| 2007/0151004 | A1 | 7/2007 | Brassill |
| 2007/0199129 | A1 | 8/2007 | Davis |
| 2008/0313793 | A1 | 12/2008 | Skottheim et al. |
| 2009/0235440 | A1 | 9/2009 | Udelhofen |
| 2009/0271916 | A1 | 11/2009 | Harris |
| 2009/0282609 | A1 | 11/2009 | Kotoske |
| 2010/0088808 | A1 | 4/2010 | Rietdyk et al. |
| 2010/0210985 | A1 | 8/2010 | Kuorak et al. |
| 2010/0242158 | A1 | 9/2010 | Blakely et al. |
| 2011/0239355 | A1 | 10/2011 | Lee |
| 2011/0247130 | A1 | 10/2011 | Lewandowski |
| 2011/0277212 | A1 | 11/2011 | Jones |
| 2011/0277226 | A1 | 11/2011 | Turner |
| 2012/0198606 | A1 | 8/2012 | Bowden et al. |
| 2012/0255094 | A1 | 10/2012 | Dragony |
| 2012/0311774 | A1 | 12/2012 | Chen et al. |
| 2013/0014318 | A1 | 1/2013 | Jourde et al. |
| 2013/0036537 | A1 | 2/2013 | Reynolds et al. |
| 2013/0232653 | A1 | 9/2013 | Conca |
| 2013/0274587 | A1 | 10/2013 | Coza et al. |
| 2014/0201883 | A1 | 7/2014 | Achtymichuk |
| 2015/0000003 | A1 | 1/2015 | Blakely et al. |
| 2015/0033451 | A1 | 2/2015 | Bradshaw |
| 2015/0101110 | A1 | 4/2015 | Wagner et al. |
| 2015/0157917 | A1 | 6/2015 | Gennario, Jr. |
| 2015/0181950 | A1 | 7/2015 | Skottheim et al. |
| 2015/0216240 | A1 | 8/2015 | Martel |
| 2015/0237924 | A1 | 8/2015 | Cosio |
| 2015/0264987 | A1 | 9/2015 | Morin et al. |

FOREIGN PATENT DOCUMENTS

| | | | |
|---|---|---|---|
| CN | 201111354 | Y | 9/2008 |
| EP | 1080647 | A2 | 3/2001 |
| JP | 3175831 | U | 5/2012 |
| WO | 2015153343 | A1 | 10/2015 |

OTHER PUBLICATIONS

"Featured Lacross Items: Hot Seller—STX Impact Shoulder Pads," Play It Again Sports®, playitagainsportsstmatthews.com, accessed: Dec. 2015. http://www.playitagainsportsstmatthews.com/equipment/category/7466, 7 pages.

"McDavid Light Shoulder Support," Amazon, amazon.com, ASIN: B002DPBH4S, accessed: Dec. 2015. http://www.amazon.com/McDavid-463R-Mcdavid-Shoulder-Support/dp/B002DPBH4S/ref=pd_sim_200_3?ie=UTF88,dpID=41o35rXbwwL&dpSrc=sims&preST=_AC_UL160_SR160%2C160_&refRID=0R4DNBSTXY2G7QNCKPZZ, 5 pages.

International Search Report and Written Opinion dated Jul. 11, 2017 in International Patent Application No. PCT/US2017/026614, 16 pages.

International Search Report and Written Opinion dated Jul. 11, 2017 in International Patent Application No. PCT/US2017/026589, 17 pages.

International Preliminary Report on Patentability dated Oct. 18, 2018 in International Patent Application No. PCT/US2017/026589, 10 pages.

International Preliminary Report on Patentability dated Oct. 18, 2018 in International Patent Application No. PCT/US2017/026601, 12 pages.

International Preliminary Report on Patentability dated Oct. 18, 2018 in International Patent Application No. PCT/US2017/026614, 9 pages.

International Search Report and Written Opinion dated Sep. 14, 2017 in International Patent Application No. PCT/US2017/026601, 22 pages.

Non-Final Office Action dated Jan. 28, 2019 in U.S. Appl. No. 15/481,304, 56 pages.

Non-Final Office Action dated Oct. 31, 2019 in U.S. Appl. No. 15/480,761, 25 pages.

Non-Final Office Action dated Aug. 27, 2019 in U.S. Appl. No. 15/481,304, 39 pages Intention to Grant received for European Patent Application No. 17719975.9, dated Jan. 16, 2020, 6 pages.

Intention to Grant received for European Patent Application No. 17721232.1, dated Jan. 17, 2020, 6 pages.

Final Office Action received for U.S. Appl. No. 15/481,304, dated Feb. 18, 2020, 39 pages.

* cited by examiner

DISCRETE SHOULDER SLEEVE FOR A SHOULDER-PAD SYSTEM

CROSS-REFERENCE TO RELATED APPLICATIONS

This application claim claims priority to U.S. Provisional Application No. 62/319,664, filed Apr. 7, 2016, titled "Discrete Shoulder Sleeve for a Shoulder-Pad System," and further claims priority to U.S. Provisional Application No. 62/319,662, filed Apr. 7, 2016, titled "Impact-Attenuation Sub-Layer for a Shoulder-Pad System," and further claims priority to U.S. Provisional Application No. 62/319,660, filed Apr. 7, 2016, titled "Securing Garment for a Shoulder-Pad System,". The entireties of the aforementioned applications are incorporated by reference herein.

TECHNICAL FIELD

This disclosure describes a shoulder-pad system and subcomponents thereof, including a discrete shoulder sleeve.

BACKGROUND

Shoulder pads are utilized in various contexts to provide protection from impact to a wearer. For example, shoulder pads are often worn in American style football, hockey, lacrosse, and motocross, among other activities. Some styles of shoulder pads include various drawbacks, such as restricted range-of-motion, which may limit the ability of a wearer to fully extend his or her arms directly overhead. In addition, some styles of shoulder pads may be too bulky or may necessitate constant readjustment after being impacted. These are only some of the exemplary issues presented by some typical shoulder pads.

BRIEF DESCRIPTION OF THE DRAWINGS

The present invention is described in detail herein with reference to the attached drawing figures, which are incorporated herein by reference, wherein.

DETAILED DESCRIPTION

Figure 1:
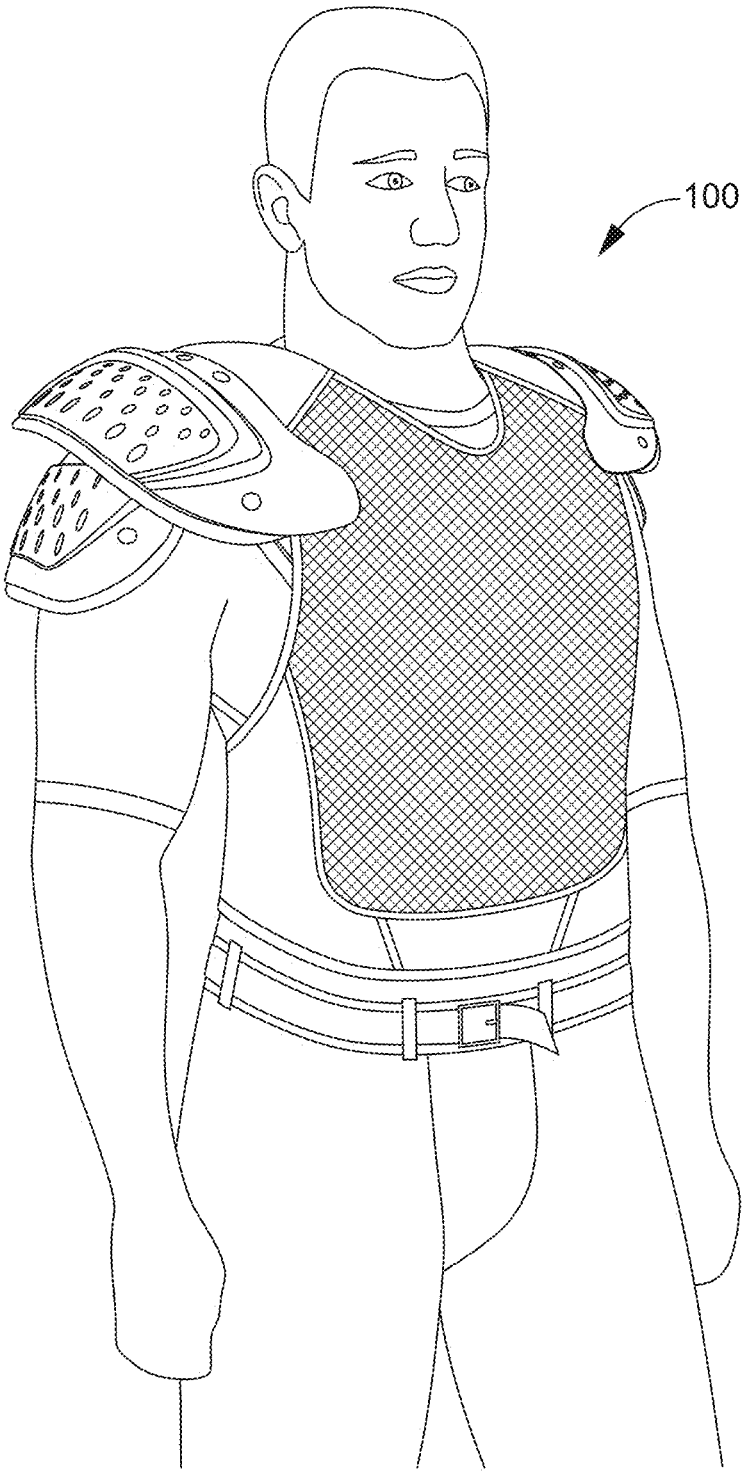
FIG. 1 depicts a person wearing the shoulder-pad system in accordance with an aspect hereof.

Subject matter is described throughout this disclosure in detail and with specificity in order to meet statutory requirements. But the aspects described throughout this disclosure are intended to be illustrative rather than restrictive, and the description itself is not intended necessarily to limit the scope of the claims. Rather, the claimed subject matter might be practiced in other ways to include different elements or combinations of elements that are similar to the ones described in this disclosure and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This principle is contemplated by and is within the scope of the claims.

Generally, aspects of this disclosure describe a shoulder-pad system having various subcomponents, such as a base layer garment, an impact-attenuation sub-layer, and an impact-plate assembly. In addition, the system may include one or more garments that are wearable to secure the base layer garment, the impact-attenuation sub-layer, the impact-plate assembly, and any combination thereof. For example, the system may include discrete shoulder sleeves that are disconnected from other garment portions and that are securable to portions of the impact-attenuation sub-layer and/or to portions of the impact-plate assembly.

The discrete shoulder sleeve may be configured to house, or at least partially encase, one or more plates of the shoulder-pad system and may include a cuff configured to fit around a wearer's upper arm. The discrete shoulder sleeve may be fitted over the wearer's arm and the shoulder pads to achieve various functionality, such as to keep proper positioning of the shoulder pads during movement while still providing sufficient range of motion for the wearer. The discrete shoulder sleeve may be releasably attachable to the epaulette so that the shoulder sleeve remains discrete in nature, allowing for use only when needed and for easier donning and doffing.

In one aspect, the disclosure includes a shoulder-sleeve garment that may be releasably coupled to an epaulette of a shoulder-pad system. The shoulder-sleeve garment includes a cuff including a band of textile forming a tubular body that may be worn over a wearer's arm. The shoulder-sleeve garment may also include a shoulder pocket coupled to the cuff, the shoulder pocket including one or more textile panels coupled to one another to form a cavity. Further, the shoulder-sleeve garment may include an epaulette attachment mechanism attached to the shoulder pocket and that is releasably attachable to the epaulette. When the shoulder pocket is releasably attached to the epaulette, the epaulette may be at least partially encased within the cavity formed by the one or more textile panels of the shoulder pocket.

Another aspect of this technology is a shoulder-pad system comprising a set of shoulder pads having an anterior plate assembly, a posterior plate assembly, a left-side shoulder assembly, and a right-side shoulder assembly. Each of the left-side shoulder assembly and the right-side shoulder assembly may comprise an epaulette having an epaulette profile and a discrete shoulder sleeve that is removably attachable to the epaulette. The discrete shoulder sleeve may include a shoulder pocket coupled with an epaulette attachment mechanism that releasably attaches to the epaulette. The shoulder pocket may have one or more textile panels coupled to one another to form a cavity and that at least partially encase the epaulette when the epaulette is positioned in the cavity. The discrete shoulder sleeve may further comprise a cuff coupled to the shoulder pocket and that includes a band of textile forming a tubular body.

In yet another aspect, the technology includes a method of donning a shoulder-pad system. The method comprises placing a set of shoulder pads onto shoulders of a wearer. The set of shoulder pads may include an anterior plate assembly, a posterior plate assembly, a left-side shoulder assembly having a left epaulette, and a right-side shoulder assembly having a right epaulette. The method may also further include affixing a left-side discrete shoulder sleeve over the left epaulette and affixing a right-side discrete shoulder sleeve over the right epaulette. The left-side discrete shoulder sleeve and the right-side discrete shoulder sleeve may be detached from an upper-body garment that at least partially covers the anterior plate assembly and the posterior plate assembly.

In some aspects, the left-side shoulder assembly includes a left shoulder cap and the right-side shoulder assembly includes a right shoulder cap. In this instance, affixing the left-side discrete shoulder sleeve over the left epaulette also includes affixing the left-side discrete shoulder sleeve over the left shoulder cap, and affixing the right-side discrete shoulder sleeve over the right epaulette also includes affixing the right-side discrete shoulder sleeve over the right shoulder cap. The method may further comprise layering the left epaulette at least partially between the left-side discrete shoulder sleeve and the left shoulder cap and layering the right epaulette at least partially between the right-side discrete shoulder sleeve and the right shoulder cap.

Having generally described various aspects of the disclosure, reference will now be made to the various figures.

Aspects of an Exemplary Shoulder-Pad System

As previously indicated, this disclosure generally describes a shoulder-pad system that may be used to attenuate impact in various contexts, such as in American-style football, lacrosse, hockey, motocross, and the like, and an exemplary shoulder-pad system 100 is illustrated in FIG. 1 in an as-worn configuration. FIG. 1 depicts the shoulder-pad system 100 in a partially assembled arrangement, and as will be described in subsequent portions of this disclosure, the shoulder-pad system 100 includes a number of subcomponents that are combinable in different arrangements to construct various portions of the shoulder-pad system 100. The shoulder-pad system 100 includes certain features and functionality that arise from the shoulder-pad system 100 as a whole. In addition, the subcomponents each include certain features and functionality that arise from the subcomponent independently, as well as the synergistic interaction of the sub-component with one or more other subcomponents.

Figure 2:
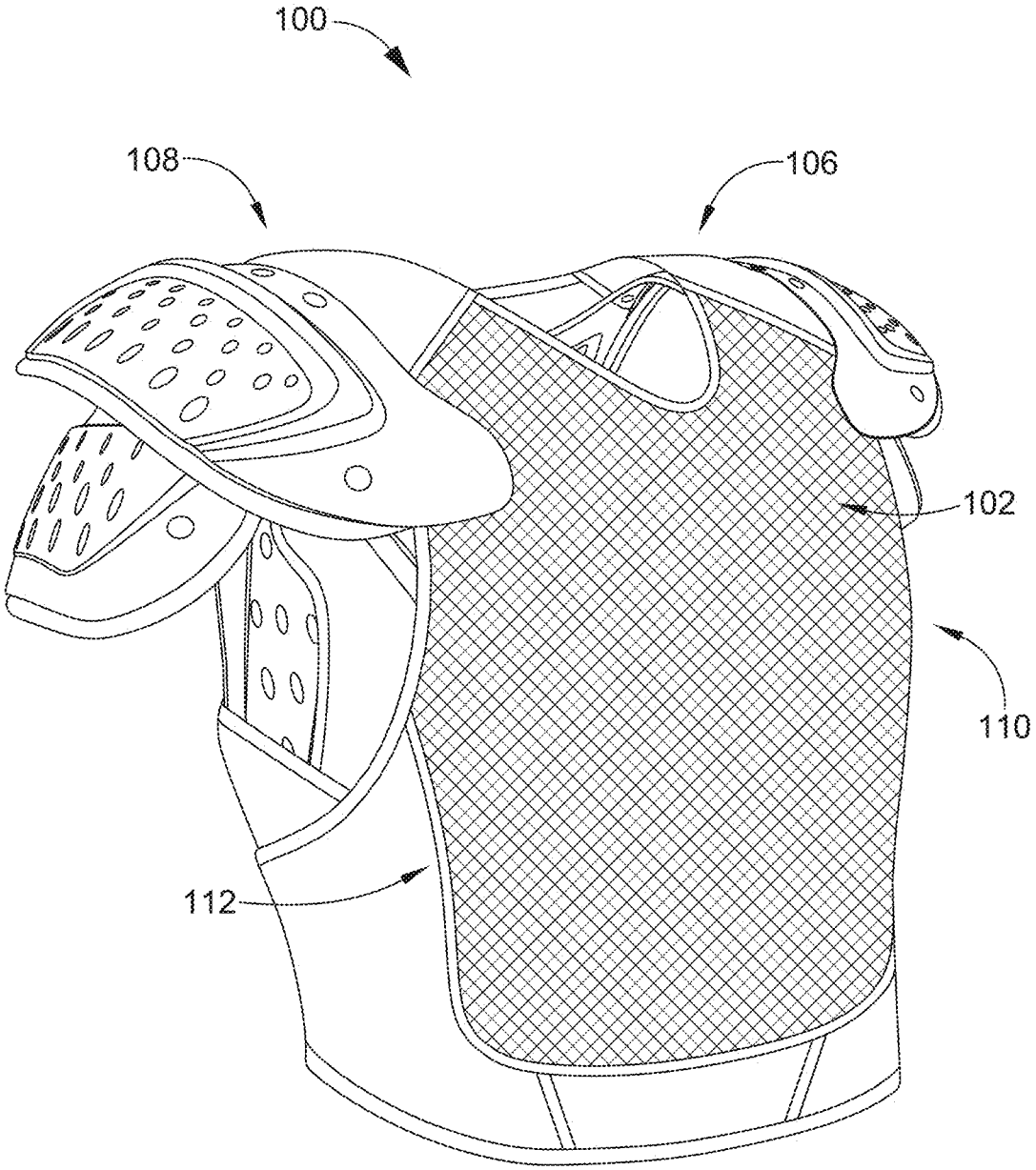
FIG. 2 depicts a front perspective view of the shoulder-pad system in accordance with an aspect hereof.
Figure 3:
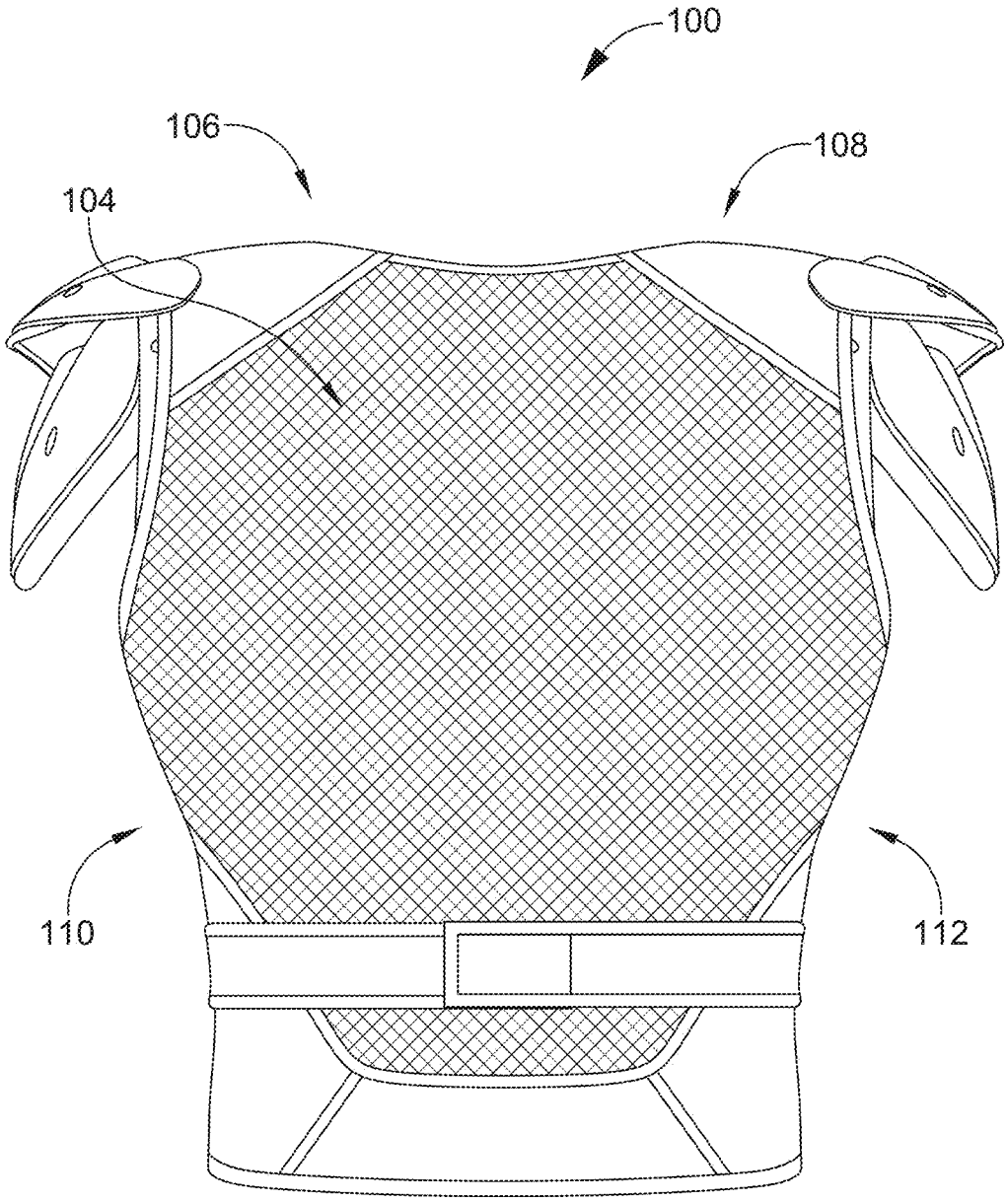
FIG. 3 depicts a back view of the shoulder-pad system in accordance with an aspect hereof.

Referring now to FIGS. 2 and 3, the shoulder-pad system 100 generally includes a yoke-like arrangement with a front and a back coupled by shoulder portions. The front, the back, and the shoulder portions define a neck-receiving opening, and in order to don or wear the shoulder-pad system 100, a person's head and neck are passed through the neck-receiving opening, such that the shoulder portions are supported on his or her shoulders. The shoulder-pad system 100 generally functions to attenuate impacts or forces to which shoulder-pad system 100 may be subjected.

When describing various aspects of the shoulder-pad system 100, relative terms may be used to aid in understanding relative relationships. For instance, the shoulder-pad system 100 may be divided into an anterior region 102 that generally corresponds with a chest and/or abdomen of a wearer, and a posterior region 104 that generally correspond with a back of a wearer, such as a cervical region, thoracic region, lumbar region, and or scapula region. Both the anterior region 102 and the posterior region 104 may include medial portions and lateral portions, the medial portions being positioned relatively more towards a vertical mid-line (based on the orientation of the system as depicted in FIG. 1) than the lateral portions. The lateral portions may include a left-lateral portion 110 and a right-lateral portion 112. In addition, both the anterior region 102 and the posterior region 104 may include inferior portions and superior portions, the inferior portions being oriented lower than the superior portions, based on the orientation of the system as depicted in FIG. 1. Furthermore, the shoulder-pad system 100 may include shoulder regions that bridge the anterior portion(s) 102 to the posterior portion(s) 104 and that generally correspond with the shoulder of a wearer. The shoulder regions include a left-shoulder region 106 that corresponds with a left laterality and a right-shoulder region 108 that corresponds with a right laterality.

The relative areas 102, 104, 106, 108, 110, and 112 are not intended to demarcate precise areas of the shoulder-pad system 100. Rather, the relative areas 102, 104, 106, 108, 110, and 112 are intended to represent general areas of the shoulder-pad system 100 to aid in understanding the various descriptions provided in this disclosure. In addition, it is understood that a portion of the shoulder-pad system 100 may include multiple regions or areas. For example, the anterior region 102 may extend through both the right-lateral side 112, the medial area, and the left-lateral side 110. And the left-lateral side 110 may include portions of both the anterior region 102 and the posterior region 104. The relative areas 102, 104, 106, 108, 110, and 112 are provided for explanatory and illustrative purposes and are not meant to depend on a human being for interpretive purposes. Accordingly, some aspects herein may be described as corresponding to a left front quadrant, a right front quadrant, a left rear quadrant, and/or a right rear quadrant.

Figure 4:
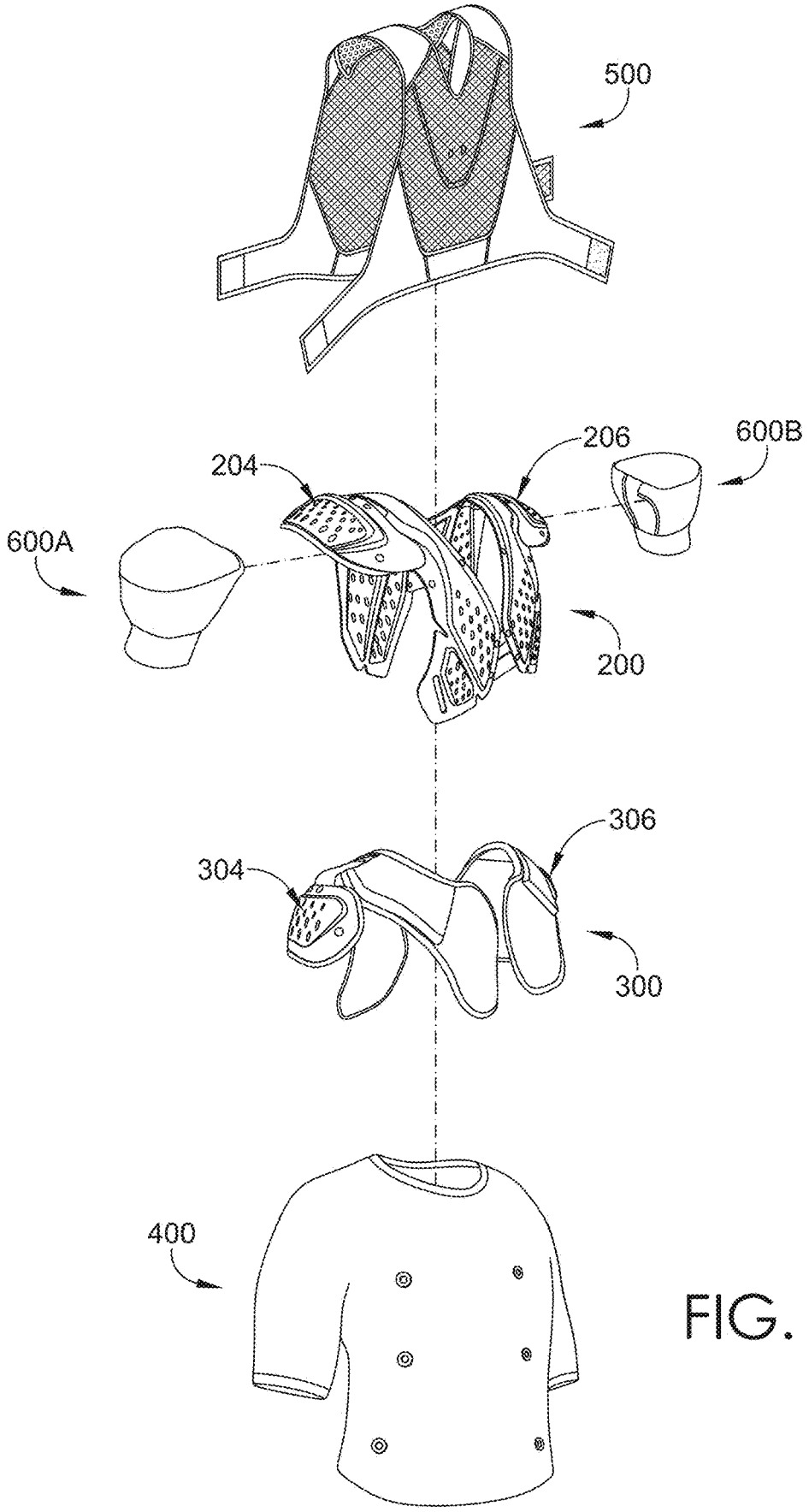
FIG. 4 depicts an exploded, front view of a shoulder-pad system in accordance with an aspect hereof.

Referring now to FIG. 4, the shoulder-pad system 100 is illustrated in an exploded view, which depicts various possible subcomponents of the shoulder-pad system 100. For example, the shoulder-pad system 100 includes an impact-plate assembly 200, an impact-attenuation sub-layer 300, and a base-layer garment 400. The base-layer garment 400 includes a variety of garments that may be worn directly under the impact-attenuation sub-layer 300, such as a sleeved shirt or sleeveless shirt. The impact-attenuation sub-layer 300 is generally a cushion layer that is removably coupled to the base-layer garment 400 and that helps to absorb and/or attenuate at least some of the impact force from the impact-plate assembly 200. The impact-plate assembly 200 is generally more rigid (as compared with the base-layer garment 400 and the impact-attenuation sub-layer 300) and includes a set of impact plates that are coupled together (e.g., chest plate, upper back plate, epaulette, etc.). The plates of the impact-plate assembly 200 may be constructed of various materials having a higher rigidity, such as a polypropylene material, a styrene-butadiene copoloymer material, carbon-fiber based material, and the like. Generally, the impact-attenuation sub-layer 300 is layered over the base-layer garment 400, and the impact-plate assembly 200 is layered over the impact-attenuation sub-layer 300.

In addition, the shoulder-pad system 100 includes various garments that fit onto, and at least partially around, different portions of the shoulder-pad system 100 in order to at least partially secure the portions of the shoulder-pad system together. In this sense, the garments may at least partially encase, wrap, or enclose portions of the shoulder-pad system. In addition, the garments may function to secure portions of the shoulder-pad system 100 to an athlete. For example, the shoulder-pad system 100 includes a securing garment 500 that is positionable over the impact-plate assembly 200 and that may be securable to the impact-plate assembly 200 and to one or more other garments (e.g., pants, belt, base layer(s), etc.). Furthermore, the shoulder-pad system 100 includes a pair of discrete shoulder sleeves 600A and 600B that are detached from other garment portions, such as the securing garment 500, base-layer garment 400, or other upper-body garments (e.g., uniform jersey), and that are attachable to other portions of the system (e.g., to an epaulette plate). The various subcomponents depicted in FIG. 4 are exemplary of one aspect of the disclosure, and these subcomponents might be modified in various manners to includes additional, fewer, or different features.

The subcomponents in FIG. 4 might be worn or utilized in various contexts and manners. For instance, the base-layer garment 400 might be positioned onto an athlete initially. The base-layer garment 400 may include one or more releasable fasteners for a releasable coupling to the impact-attenuation sub-layer 300. Accordingly, the impact-attenuation sub-layer 300 may be coupled and decoupled with the base-layer garment 400 as desired or needed by the athlete. The impact-attenuation sub-layer 300 may also be attached to the base-layer garment 400 before the base-layer garment 400 is donned, such that the combination of the base-layer garment 400 coupled with the impact-attenuation sub-layer 300 may be donned or put on at the same time. The impact-plate assembly 200 may be positionable over the impact-attenuation sub-layer 300, such that at least part of the impact-attenuation sub-layer 300 is nested beneath shoulder portions of the impact-plate assembly 200. As can be appreciated, the impact-plate assembly 200 might be overlaid atop the impact-attenuation sub-layer 300 either before the athlete dons the impact-attenuation sub-layer 300 and base-layer garment 400, or while the impact-attenuation sub-layer 300 and base-layer garment 400 are being worn.

The impact-plate assembly 200 and the impact-attenuation sub-layer 300 may be substantially retained in a particular position or arrangement using various features. For example, the securing garment 500 may be overlaid atop the impact-plate assembly 200 and coupled to other portions of the shoulder-pad system 100, to other garments (e.g., pants, belt, base layers, etc.), to the athlete, or any combination thereof. The securing garment 500 is depicted as a bib garment (or a tank-style garment), and other aspects of the disclosure may include a number of other suitable upper-body garments for securing the impact plate assembly 200. The securing garment 500 may then be attached to one or more various anchor points on the impact plate assembly 200, on other garments (e.g., pants, belt, etc.), on the athlete, or any combination thereof. In addition, the discrete shoulder sleeves 600A and 600B are each securable around a portion of an arm of the athlete, as well as to a respective portion of the impact-plate assembly, such as to an epaulette plate (e.g., 204) of the impact-plate assembly 200, a respective shoulder-cap (e.g., 304) of the impact-attenuation sub-layer 300, or both the epaulette plate and the shoulder-cap. In this respect, the discrete shoulder sleeves 600A and 600B are also securing garments that function to couple various portions of the shoulder-pad system 100 together and to the athlete.

The shoulder-pad system 100 may be described as modular, in that the various subcomponents may be added to, and/or removed from, the system when it is desirable to do so. In addition, the system is modular in the sense that one or more subcomponents may be selectively repositioned within the system without necessarily affecting a portion or function of other subcomponents. As such, the system may include one or more layers or sub-layers that are modular.

The one or more subcomponents of the shoulder-pad system 100 may be utilized in various contexts. For instance, the entire system 100 may be worn in certain circumstances, and in other occasions, only some of the subcomponents may be worn. For example, the base-layer garment 400 might initially be positioned onto an athlete, and one or more subcomponents may or may not be layered onto the base-layer garment 400 depending on the activity. If the athlete is engaging in warm-ups, conditioning, or non-contact drills, then the athlete may not layer the impact-attenuation sub-layer 300 onto the base-layer garment 400. Further, it may be desirable in other instances to include the impact-attenuation sub-layer 300 without the impact-plate assembly 200, such as in a 7-on-7 drill or other light-contact drills.

The various subcomponents each includes certain features and functionality that arise from the sub-component independently, as well as the synergistic interaction of the sub-component with one or more other subcomponents. Some of these aspects of the technology are generally described in this portion of the disclosure, and they will be described in more detail in other portions of the Specification. For example, one or more of the subcomponents may provide an amount of range of motion for a wearer, such as a shoulder range of motion or an arms-overhead range of motion. In addition, one or more of the subcomponents may provide system-stability features that improve the ability of the subcomponents to attenuate an impact and to remain in, or easily return to, a pre-impact state or arrangement. Additional features of the subcomponents may reduce or alleviate some maintenance often performed on more traditional padding systems, as well as improve the launderability of the subcomponents. Furthermore, one or more of the subcomponents may be customizable to a particular athlete or group of athletes. These features and functionality, as well as others, of the shoulder-pad system 100 and the various subcomponents will be described in additional detail in other parts of this disclosure.

Aspects of an Exemplary Discrete Shoulder Sleeve

Referring now to FIGS. 5-8, one subcomponent of the shoulder-pad system 100 includes a discrete shoulder sleeve 600. The discrete shoulder sleeve 600 may be worn over portions of other subcomponents of the shoulder-pad system 100, such as the impact-plate assembly 200 and, in some embodiments, the impact-attenuation sub-layer 300. More specifically, each epaulette 204 and 206 and, in some aspects, each shoulder cap 304 and 306 may be positioned within a cavity (such as cavity 652 shown in FIG. 7 and discussed below) formed by each discrete shoulder sleeve 600. As used in this disclosure, the epaulettes 204 and 206 include plates that generally cover a wearer's shoulder, and the epaulettes 204 and 206 are coupled to the shoulder portions of the impact-plate assembly 200. The shoulder caps 304 and 306 generally cover an upper arm region, such the deltoid region, and are affixed underneath the epaulettes 204 and 206. By enclosing the epaulettes 204 and 206 and shoulder caps 304 and 306 in a cavity, the discrete shoulder sleeves 600A-B may retain proper positioning of the epaulettes 204 and 206 and shoulder caps 304 and 306 during movement and impact. Additionally, if the epaulettes 206 and 206 and the shoulder caps 304 and 306 are moved out of position, the discrete shoulder sleeves 600A-B may allow the epaulettes 206 and 206 and the shoulder caps 304 and 306 to return more easily to their pre-impact arrangements. By doing so, the discrete shoulder sleeves 600 may prevent the athlete from needing to frequently readjust various parts of the shoulder-pad system 100 while the shoulder-pad system 100 is being worn.

FIGS. 5-8 provide various views of the discrete shoulder sleeve 600. Though the discrete shoulder sleeve 600 shown is the left-side discrete shoulder sleeve (600B in FIG. 4), the description of the discrete shoulder sleeve 600 is not limited to the left side as it applies equally to the right-side discrete shoulder sleeve (600A in FIG. 4). Additionally, because the discrete shoulder sleeve discussed throughout this disclosure is typically the left-side discrete shoulder sleeve, the other components discussed may also be left-side components without necessarily identifying them as such. The respective sides of each component will be identified separately when necessary.

Turning to FIGS. 5-8, the discrete shoulder sleeve 600 may comprise a shoulder pocket 610 and a cuff 620. The cuff 620 may be configured to be worn around the wearer's arm and may include a band of one or more textile segments that form a tubular body. The band of textile may form a continuous tubular body such that the cuff 620 does not lose its tubular shape as the shoulder sleeve 600 is being donned and doffed. In other words, the cuff 620 may be donned without using a releasable coupling mechanism, such as by sliding the tubular body of the cuff 620 up the arm of the wearer. In alternative aspects, the cuff 620 may have two separate ends with one or more releaseable coupling mechanisms, such as snap fasteners using a socket and stud component, releasable adhesives such as Velcro, hook-and-loop fasteners, and the like, to releasably secure the two ends for holding the cuff 620 in place on a wearer's arm.

A fit of the cuff 620 may be controlled or affected using various mechanisms. For instance, in one aspect the one or more textile segments include an amount of elasticity that is selected to provide an amount of compression. In addition, the cuff 620 may be constructed to include adjustment mechanisms (e.g., slides, buckles, and the like) or releasable fasteners (e.g., snaps, buttons, hook-and-loop fasteners, and the like, that may be selectively adjusted to affect the fit.

In some aspects, the cuff 620 is designed to be worn only over the upper bicep region of a wearer. Accordingly, a length 664 of the cuff 620 between an inferior edge and a superior edge may be in a range between two inches to five inches. The length 664 may be shorter or longer, depending on how much of the arm the shoulder sleeve 600 is designed to cover. For example, in other aspects, the cuff 620, when worn, may run from the upper bicep region to the forearm, or between the upper bicep region to the wearer's wrist. As such, the cuff 620 may also include a sleeve having various lengths, including short-sleeved length, three-quarter length, or long-sleeve length.

Continuing to the rest of the shoulder sleeve 600, the cuff 620 may be coupled to the shoulder pocket 610. The shoulder pocket 610 may include one or more textile panels to form a cavity, which may be used to encase at least the epaulette as is discussed further. For example, the shoulder pocket 610 may include a side panel 630 and a top panel 640. The side panel 630 may further comprise an anterior side panel 632, a lateral side panel 634, and a posterior side panel 636. These panels 632, 634, and 636 that comprise the side panel 630 are not necessarily discrete panels or textile pieces but, rather, are identified to describe different portions of the side panel 630.

Figure 6:
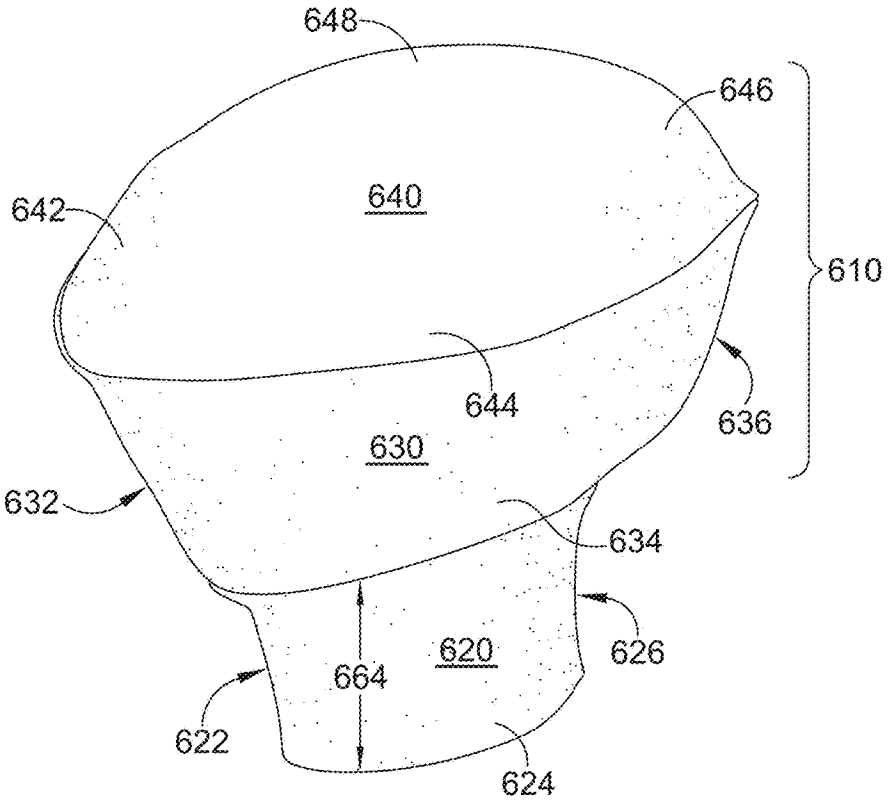
FIG. 6 depicts a lateral view of the discrete shoulder sleeve in accordance with an aspect hereof.
Figure 5:
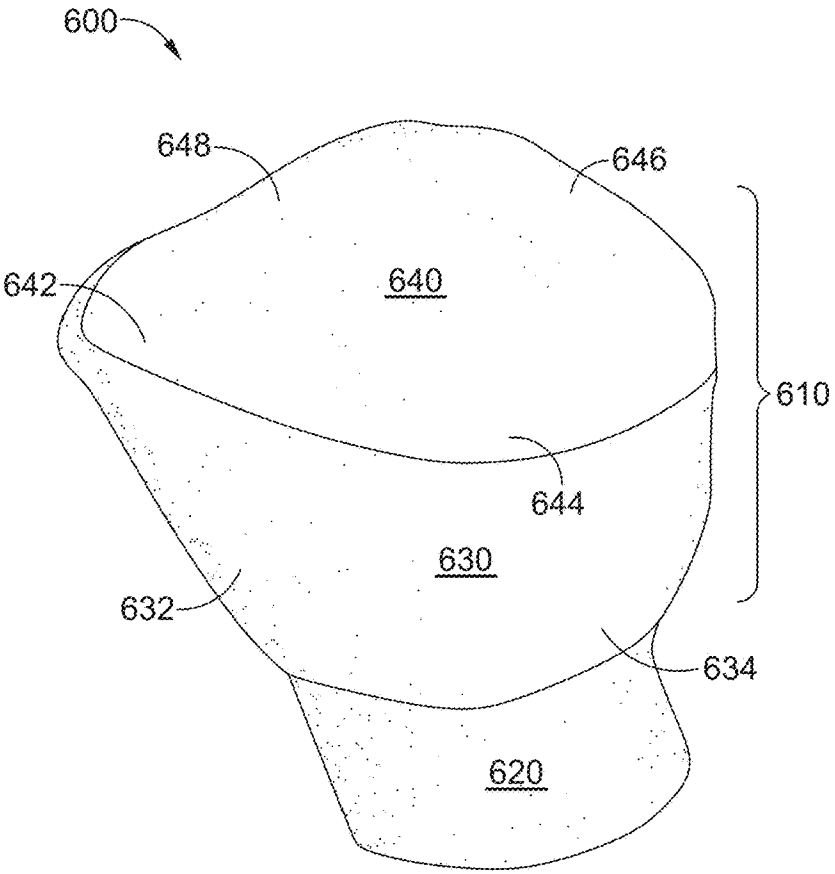
FIG. 5 depicts a front, perspective view of a discrete shoulder sleeve in accordance with an aspect hereof.

Additionally, panels 632, 634, and 636 may correspond to portions of the cuff 620 to which they are attached. For example, the anterior side panel 632 may be attached to a cuff anterior portion 622; the lateral side panel 634 may be attached to a cuff lateral portion 624; and a posterior side panel 636 may be attached to a cuff posterior portion 626. Similarly, the top panel 640 may be attached to the side panel 630 and include various portions corresponding to the panels 632, 634, and 636 of the side panel 630 to which they attach. A top-panel anterior portion 642 may attach to the anterior side panel 632; a top-panel lateral portion 644 may attach to the lateral side panel 634; and a top-panel posterior portion 646 may attach to the posterior side panel 636. While the panels 632, 634, and 636 of the side panel 630 are separately described as being attached to specified portions of the cuff 620 and the top panel 640, it may be understood that the points of attachment between the panels 632, 634, and 636 and the cuff 620 and the points of attachment between the panels 632, 634, and 636 and the top panel 640 are each continuous. For example, the side panel 630 may be stitched to each the cuff 620 and the top panel 640 in a continuous stitch, as shown in FIGS. 5-6.

Figure 8:
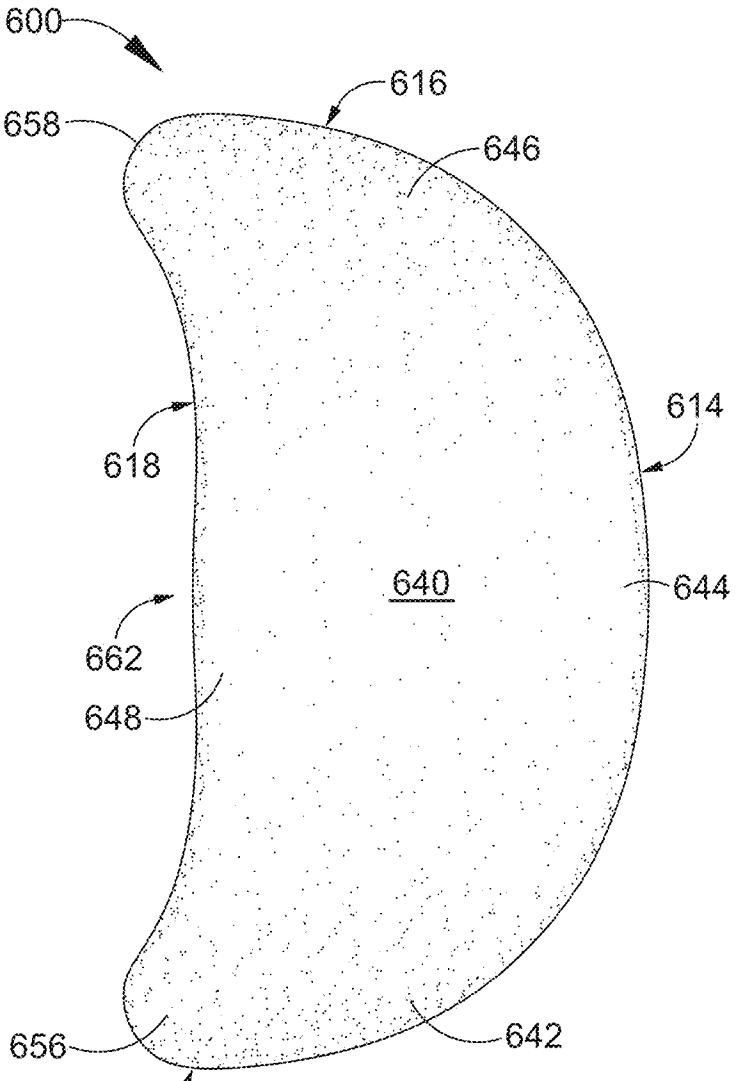
FIG. 8 depicts a top view of the discrete shoulder sleeve in accordance with an aspect hereof.
Figure 7:
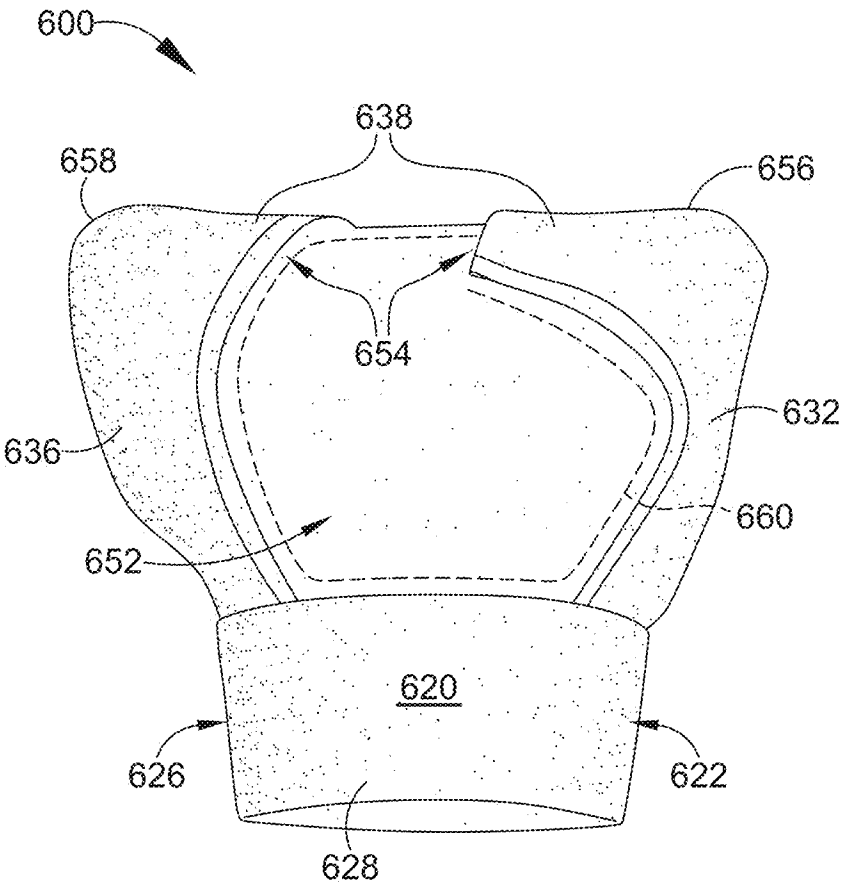
FIG. 7 depicts a medial view of the discrete shoulder sleeve in accordance with an aspect hereof.

As seen in FIGS. 7-8, there may also be a cuff medial portion 628 and a top-panel medial portion 648. In some aspects, at least a portion of the cuff medial portion 628 and at least a portion of the top-panel medial portion 648 may be detached from the side panel 630. By leaving at least a portion of the cuff medial portion 628 and the top-panel medial portion 648 unattached to the side panel 630, the sleeve 600 is constructed to include an arm-receiving hole 660. The perimeter edge of the arm-receiving hole 660 (depicted as a dashed line in FIG. 7), may be formed by the anterior side panel 632, the posterior side panel 636, and the detached portions of the top-panel medial portion 648 and the cuff medial portion 628.

Though a portion of the top-panel medial portion 648 may be detached from the side panel 630, other portions of the top-panel medial portion 648 may be attached to one or more portions of the side panel 630. As shown in FIG. 7, the anterior side panel 632 may be attached to an anterior portion of the top-panel medial portion 648, and the posterior side panel 636 may be attached to a posterior portion of the top-panel medial portion. In this way, at least a portion of a medial side of the cavity 652 is defined by the side panel 630, thereby creating a partial medial side panel 638, which may form flanges for at least partially encasing and wrapping onto portions of the shoulder-pad system.

Turning to the top view of the discrete shoulder sleeve 600 provided in FIG. 8, the top panel 640 is shown. As described in greater detail below, the top panel 640 may overlay an epaulette (such as 206 in FIG. 4) when the discrete shoulder sleeve 600 is attached to the epaulette.

Accordingly, at least part of the shape of the top panel 640 may generally correspond to the shape, or profile, of the epaulette to which it attaches. In the aspect depicted, an anterior edge 612, a lateral edge 614, and a posterior edge 616 of the top panel 640 together form a convex edge. In addition, a medial edge 618 of the top panel 640 may have a generally concave edge with a medial edge 618 mid-section, also referred to as the protruding edge 662, being slightly convex. In other aspects, the curvature of the protruding edge 662 may be more pronounced. Additionally, the protruding edge 662 in some aspects may be more anteriorly positioned or more posteriorly positioned, and some aspects may include more than one protruding edge 662. Although the protruding edge 662 is shown as a section of the medial edge 618, the protruding edge 662 may be part of a different edge of the top panel 640.

Continuing, the top panel 640 may include an anterior transition 656 between the top-panel anterior portion 642 and the top-panel medial portion 648 and a posterior transition 658 between the top-panel posterior portion 646 and the top-panel medial portion 648. The anterior and posterior transitions 656 and 658, respectively, may comprise the rounded corners seen in FIG. 8 where the perimeter of the top panel 640 transitions between convex and concave edges. This transition from the convex to the concave edges forms protruding portions that extend outward, and the part of the cavity 652 positioned at the transitions 656 and 658 form at least part of an epaulette-receiving slot 654 that may receive an epaulette (such as epaulette 206 in FIG. 4) that is coupled to the discrete shoulder sleeve 600.

Turning to FIGS. 9A, 9B, 10, and 11, views of the discrete shoulder sleeve 600 as it is used with an epaulette 206 and other subcomponents of the shoulder-pad system 100 are provided. The shoulder-pad system 100 may include a set of shoulder pads. Specifically, the shoulder-pad system 100 may include a left-side shoulder assembly 222 (that includes at least a left epaulette 206) and a right-side shoulder assembly 220 (that at least includes a right epaulette 204). There may also be an anterior plate assembly 207 comprising a right anterior plate 208 and a left anterior plate 210 and that is generally configured to cover at least a portion of the wearer's chest. There may further be a posterior plate assembly (not visible in FIG. 10 but see 211 in FIG. 14A) comprising a right posterior plate (e.g., 212 in FIG. 14A) and a left posterior plate (e.g., 214 in FIG. 14A) and that is generally configured to cover at least part of the wearer's upper back. The anterior plate assembly 207 and the posterior plate assembly may generally connect the left-side shoulder assembly 222 and right-side shoulder assembly 220.

Using the left side as an example, the discrete shoulder sleeve 600 may be detached from the shoulder assembly 222 and may be releasably coupled to the epaulette 206 through an epaulette-attachment mechanism on the discrete shoulder sleeve 600. In the aspect illustrated, the epaulette-attachment mechanism comprises the protruding edge 662 and the epaulette-receiving slot 654 (shown in FIG. 11). The epaulette attachment mechanism works to keep the discrete shoulder sleeve 600 in place over the epaulette 206 when being worn together.

Specifically, the epaulette 206 may be positioned in the cavity 652 formed by the side panel 630 and the top panel 640, such that the shoulder pocket 610 at least partially encases the epaulette 206. When positioned in the cavity 652, the top panel 640 of the discrete shoulder sleeve 600 may overlay a crown-side surface 202 of the epaulette 206, which is shown in the cross-sectional view provided in FIG. 11. As previously discussed, the shape of the top panel 640 may correspond to the profile of the epaulette 206. Accordingly, as the top panel 640 overlays the crown-side surface 202 of the epaulette 206, the perimeter of the top panel 640 may be generally aligned with the perimeter of the epaulette 206. For example, the protruding edge 662 of the top panel 640 may be aligned with the protruding edge 282 of the epaulette 206. Additionally, the crown-side surface 202 of the epaulette 206 may be slightly convex. Accordingly, when the top panel 640 overlays the crown-side surface 202, the top panel 640 may also take on a convex shape.

As the epaulette 206 is inserted into the cavity 652 of the discrete shoulder sleeve 600, via the arm-receiving hole 660, the epaulette 206 may be positioned underneath the top panel 640 so that the top panel 640 and the epaulette 206 are aligned. At the same time, the epaulette 206 may be positioned within the epaulette-receiving slot 654. When the epaulette 206 is fully inserted into the epaulette-receiving slot 654, the partial medial side panel 638 may be pulled over the protruding edge 282 of the epaulette 206 so that the partial medial side panel 638 is medially positioned relative to the epaulette 206. In this way, the shoulder pocket 610 is at least partially wrapped around the protruding edge 282 of the epaulette 206, thereby coupling the discrete shoulder sleeve 600 to the epaulette 206.

Though the epaulette attaching mechanism of the discrete shoulder sleeve 600 is described above as comprising at least a protruding edge 662 and/or the epaulette-receiving slot 654, it is understood that other means for releasably coupling the discrete shoulder sleeve 600 and the epaulette 206 may be used in addition or in the alternative. The epaulette attachment mechanism may include one or more as snap fasteners using a socket and stud components, releasable adhesives, hook-and-loop fasteners, and the like. For example, there may be a plurality of snap fastener components on a medial side of the shoulder pocket 610, such as the partial medial side panel 638 and/or the top-panel medial portion 648, that may be releasably coupled to corresponding snap fastener components on a medial side of the epaulette 206.

Figure 9A:
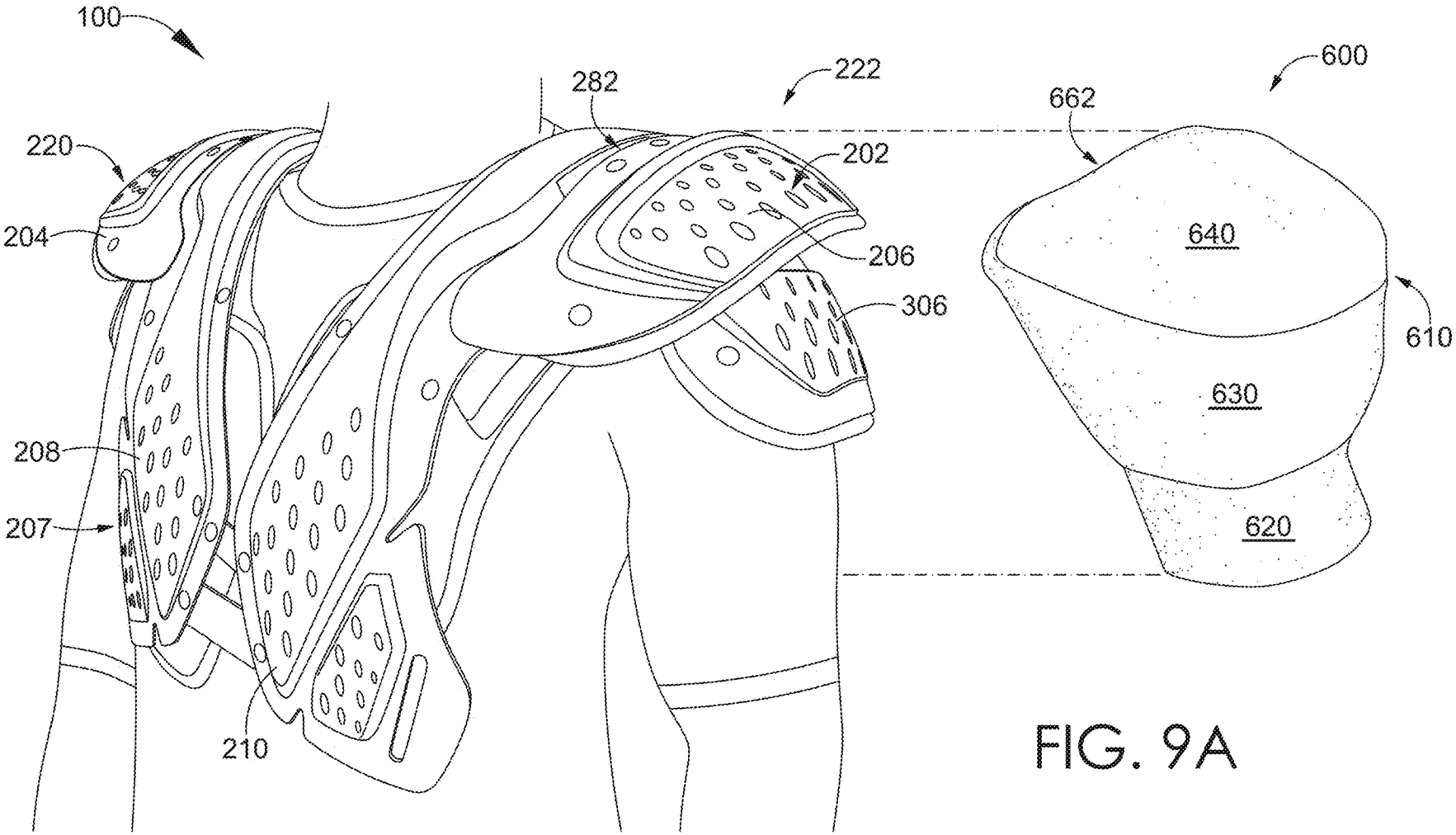
FIG. 9A depicts an exploded, perspective view of the discrete shoulder sleeve and other subcomponents of the shoulder-pad system in accordance with an aspect hereof.
Figure 9B:
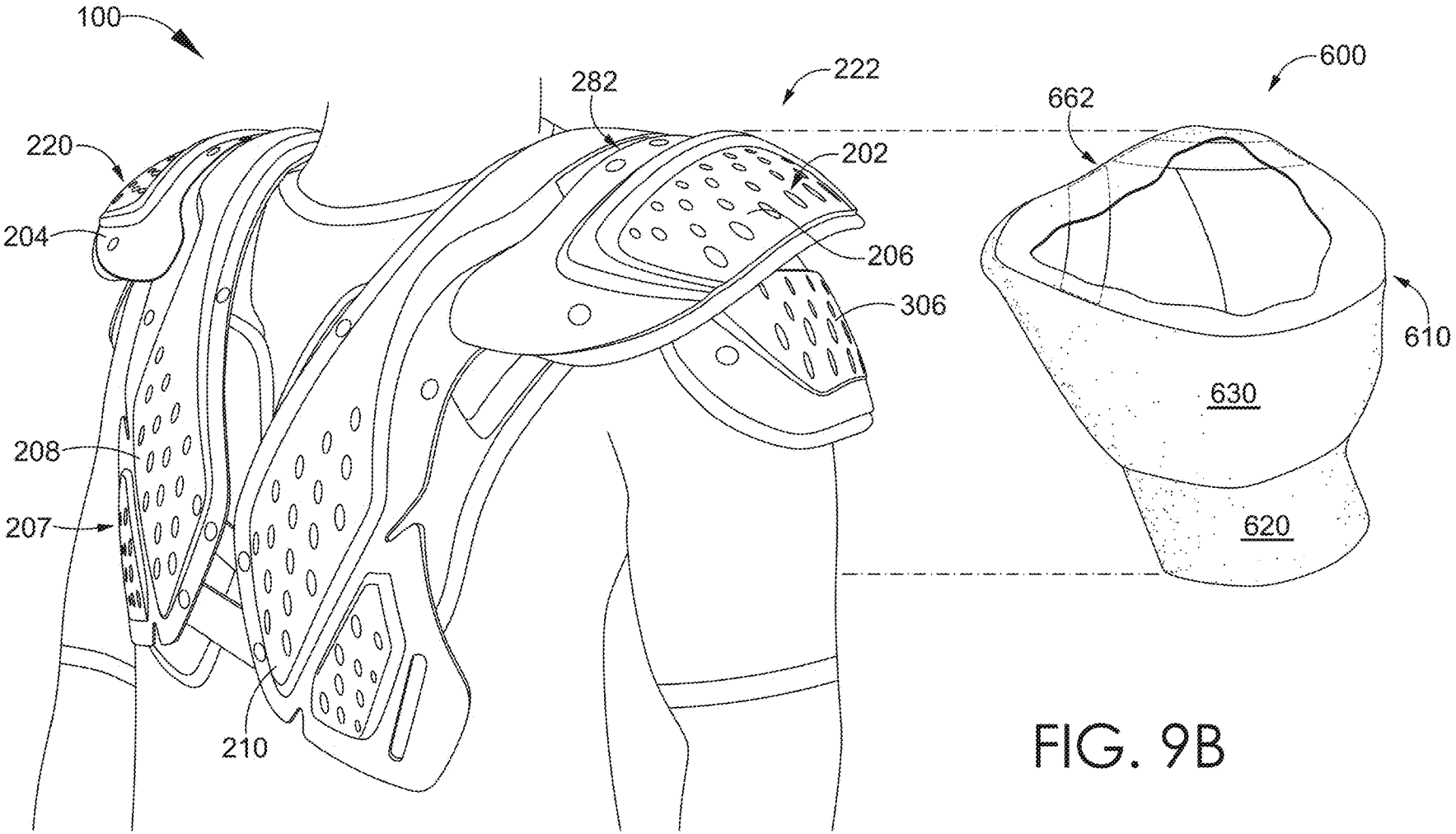
FIG. 9B depicts a view similar to FIG. 9A of an alternative discrete shoulder sleeve in accordance with an aspect hereof.
Figure 10:
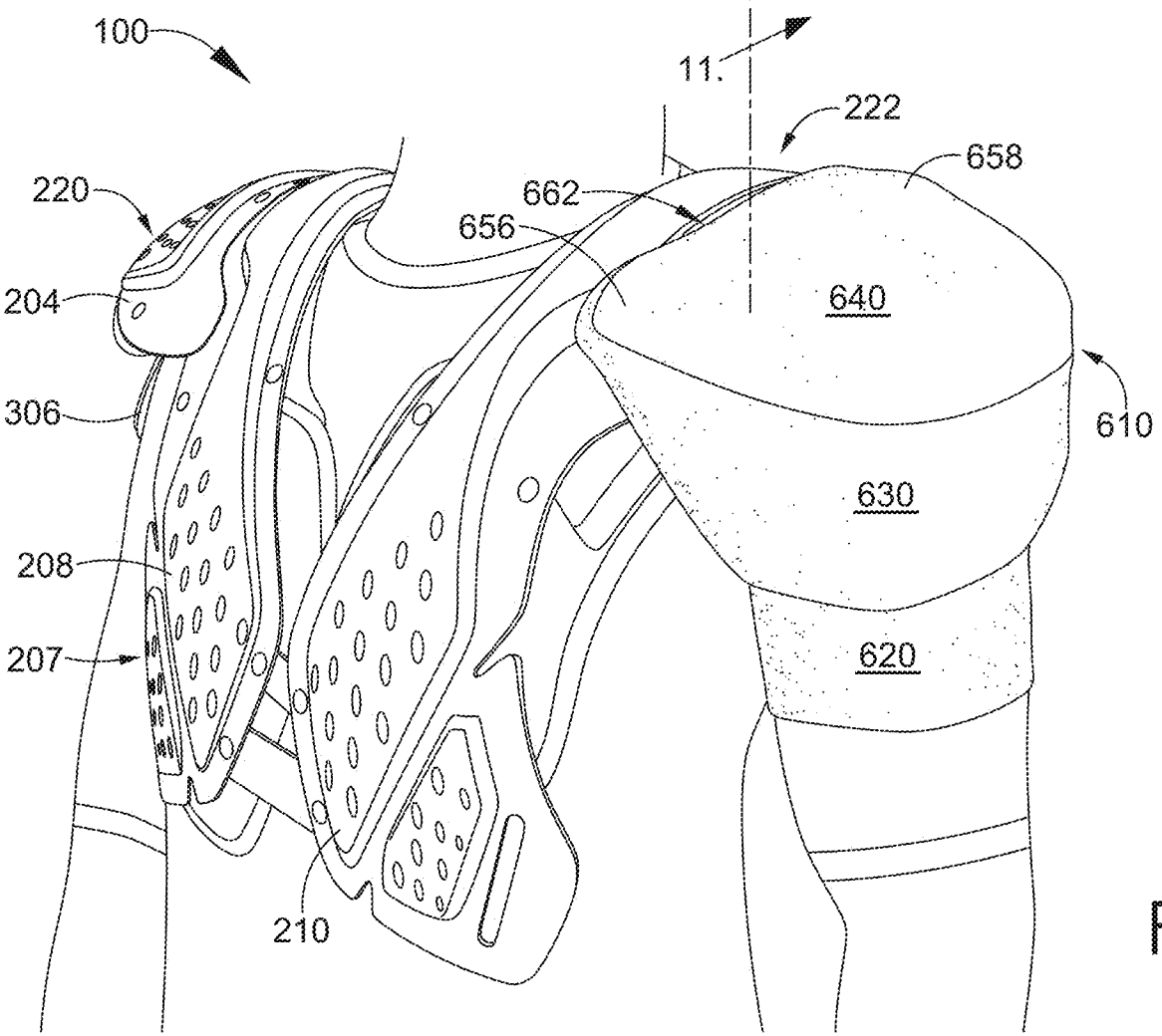
FIG. 10 depicts a perspective view of the discrete shoulder sleeve releasably attached to an epaulette in accordance with an aspect hereof.

FIG. 9B illustratively depicts an alternative aspect of a sleeve 601 in which the top panel has been cutaway to reveal a first band 690 and a second band 692. The first band 690 and the second band 692 may be wrapped underneath the epaulette 206 when the sleeve 601 is arranged over the top of the epaulette 206. These bands 690 and 692 may be combined with the epaulette-receiving slots or may be used instead of the slots. Furthermore, the bands 690 and 692 may be constructed of an elastic material that stretches to wrap over the epaulette and then contracts to pull the sleeve 601 against the epaulette 206.

In addition to the epaulette 206, a shoulder cap 306 may also be encased within the shoulder pocket 610. The shoulder cap 306 may be positioned generally inferior to, and layered beneath, the epaulette 206, and, together, the epaulette 206 and the shoulder cap 306 may form the shoulder assembly 222. As depicted in FIG. 4, however, the shoulder cap 306 and the epaulette 206 may be subcomponents of separate components of the shoulder-pad system 100. Specifically, the epaulette 206 may be a subcomponent of the impact-plate assembly 200, and the shoulder cap 306 may be a subcomponent of the impact-attenuation sub-layer 300. In alternative aspects, the shoulder cap 306 may be attached directly to the epaulette 206 or a component that is attached to the epaulette, such as the impact-plate assembly 200.

Figure 11:
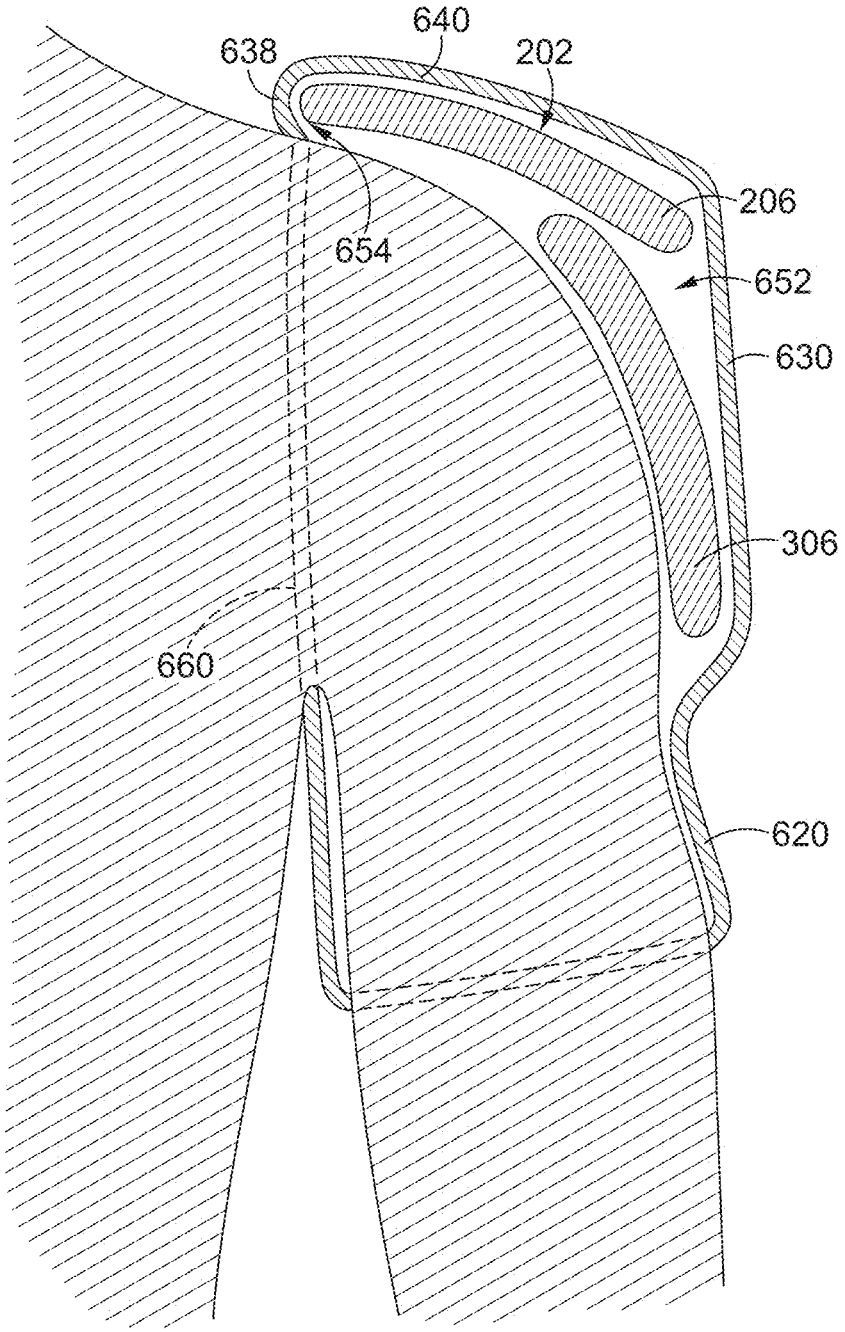
FIG. 11 depicts a cross-sectional view of the discrete shoulder sleeve releasably attached to an epaulette in accordance with an aspect hereof.

As the epaulette 206 is inserted into the epaulette-receiving slot 654, at least part of the shoulder cap 306 may also be positioned within the cavity 652 of the shoulder pocket 610, as shown in FIG. 11. When positioned within the cavity 652, the shoulder cap 306 may be inferior to the epaulette 206 and superior to the cuff 620. Accordingly, the discrete shoulder sleeve 600 provides a single cavity 652 or pocket for encasing the epaulette 206 and shoulder cap 306. By doing so, the discrete shoulder sleeve 600 may assist with maintaining a desired position of the epaulette 206 and shoulder cap 306 with respect to each other and other components of the shoulder-pad system 100.

To further aid with proper positioning, the discrete shoulder sleeve 600 may be tightly fitted over the epaulette 206 and over the wearer's arm. Accordingly, the discrete shoulder sleeve 600 may be constructed from a knitted or woven material with elastic properties. An exemplary material includes spandex or a textile comprising a percentage of spandex content. The material may also be a moisture wicking material to pull away moisture, such as perspiration, from the wearer's skin.

The discrete shoulder sleeve 600 may comprise a single textile material, or the shoulder pocket 610 and the cuff 620 may be formed from different materials. For example, the cuff may be of a material with a first elastic content and the shoulder pocket 610 may be constructed form a material with a second elastic content. The first elastic content of the cuff 620 may be higher than the second elastic content of the shoulder pocket 610 to provide a tighter fit around the wearer's arm while allowing the sufficient range of motion for the shoulders.

As previously mentioned, use of an elastic material for the discrete shoulder sleeve 600 provides a compression fit over the epaulette 206 and, in some aspects, the shoulder cap 306 to keep proper positioning of those components while still allowing the wearer to have a range of motion necessary when playing a contact sport, such as American-style football, lacrosse, hockey, motocross, and the like. Using an elastic material to cover the epaulette 206 and shoulder cap 306 also helps to prevent portions of other garments (e.g., a jersey) from being caught underneath or between the shoulder pad components. Further, constructing the shoulder pocket 610 from an elastic material aids in coupling the shoulder pocket 610 and the epaulette 206. When the epaulette 206 is inserted into the cavity 652, tension is created over portions of the shoulder pocket 610, including along the protruding edge 662 and the transitions 656 and 658, due to the elastic material. This tension aids the epaulette attachment mechanism to keep the discrete shoulder sleeve 600 coupled to the epaulette 206 during movement and/or impact.

Figure 13:
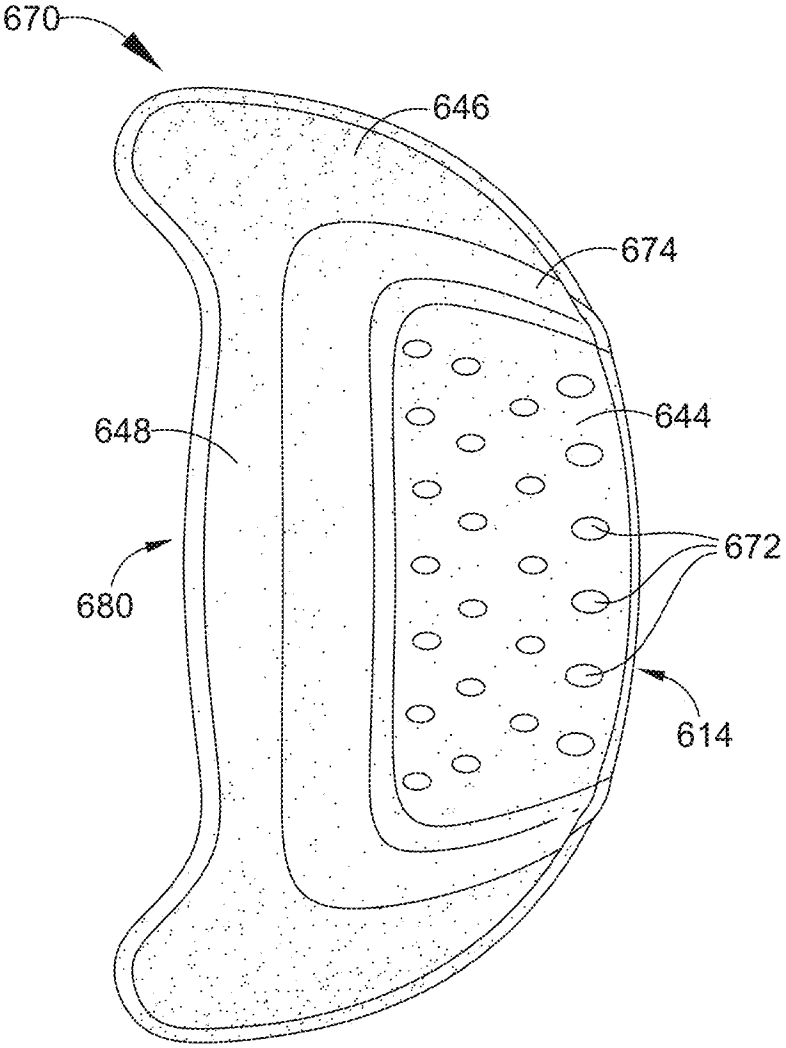
FIG. 13 depicts a top view of a discrete shoulder sleeve with a cushion element in accordance with an aspect hereof.
Figure 12:
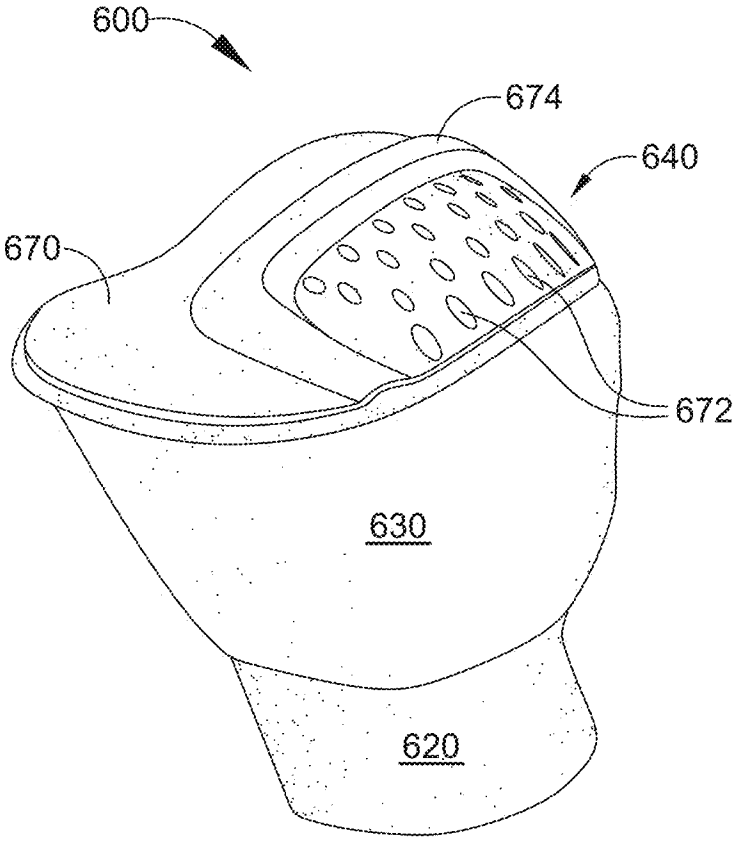
FIG. 12 depicts a front, perspective view of a discrete shoulder sleeve with a cushion element in accordance with an aspect hereof.

Turning to FIGS. 12-13, an alternative aspect of the discrete shoulder sleeve 600 is provided. As illustrated, the top panel 640 may include a cushion element 670. The cushion element 670 may provide increased durability for the top panel 640 so that the top panel 640 does not become worn and degraded easily due to frequent contact with other athletes, including any padding or helmets worn by the athletes. Consequently, the cushion element 670 may be constructed of a durable material. The cushion element 670 may also help to absorb some of the contact force. The cushion element 670 may, therefore, be constructed from a durable but semi-pliable material. Exemplary materials for the cushion element 670 may include a thermoplastic elastomer, a thermoset elastomer, rubber, synthetic rubber, polyurethane foam, foam latex, and the like.

In some aspects, the cushion element 670 may overlay a textile layer that forms the top panel 640 with the cushion element 670. Alternatively, the cushion element 670 may be used for the top panel 640 in lieu of a textile layer. Additionally, the cushion element 670 may comprise various other features that may correspond to features on an epaulette or other shoulder pad component over which the cushion element 670 lays. For example, the cushion element 670 may include a plurality of holes 672 along the top-panel lateral portion 644. The plurality of holes 672 may be used to decrease wind resistance when a wearer is running while slightly bent forward and provide ventilation for the athlete by creating an air flow inside the shoulder pocket 610. The plurality of holes 672 may be uniform or may be of varying sizes and shapes within the cushion element 670. The plurality of holes 672 on the cushion element 670 in FIGS. 12-13, for instance, are larger near the lateral edge 614 compared to holes further from the lateral edge 614. Each of the plurality of holes 672 may further include a mesh element over the hole.

The cushion element 670 may also include a central ridge 674. The central ridge 674 illustrated in FIG. 13 extends medially from a more posterior point on the lateral edge 614 of the top-panel lateral portion 644 towards the top-panel medial portion 648, then extends posteriorly towards the top-panel posterior portion 646, and then extends laterally towards a more posterior point on the lateral edge 614 of the top-panel lateral portion 644.

Figure 14A:
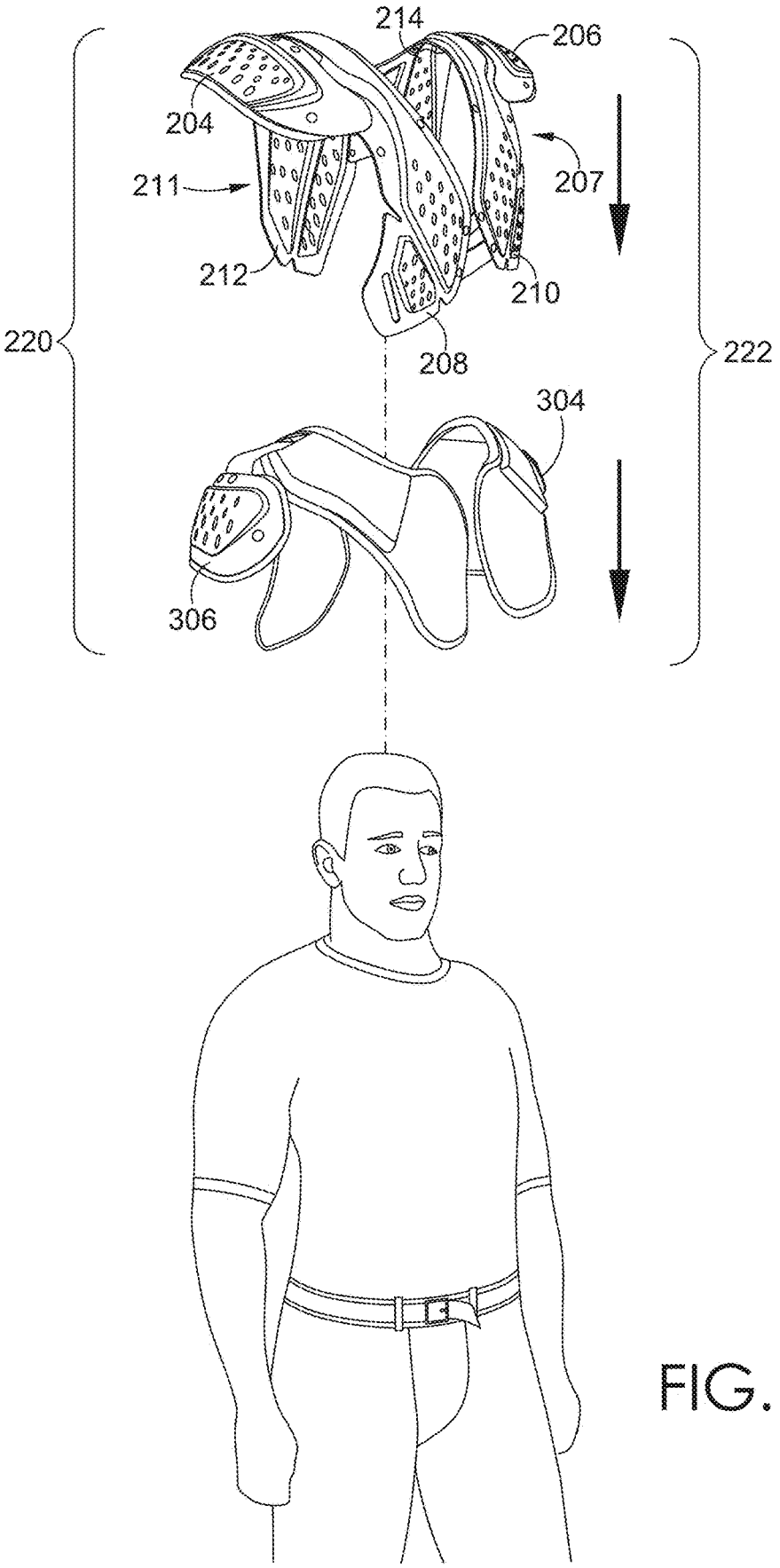
FIG. 14A-B depict front, perspective views of components of the shoulder-pad system being donned in accordance with an aspect hereof.
Figure 14B:
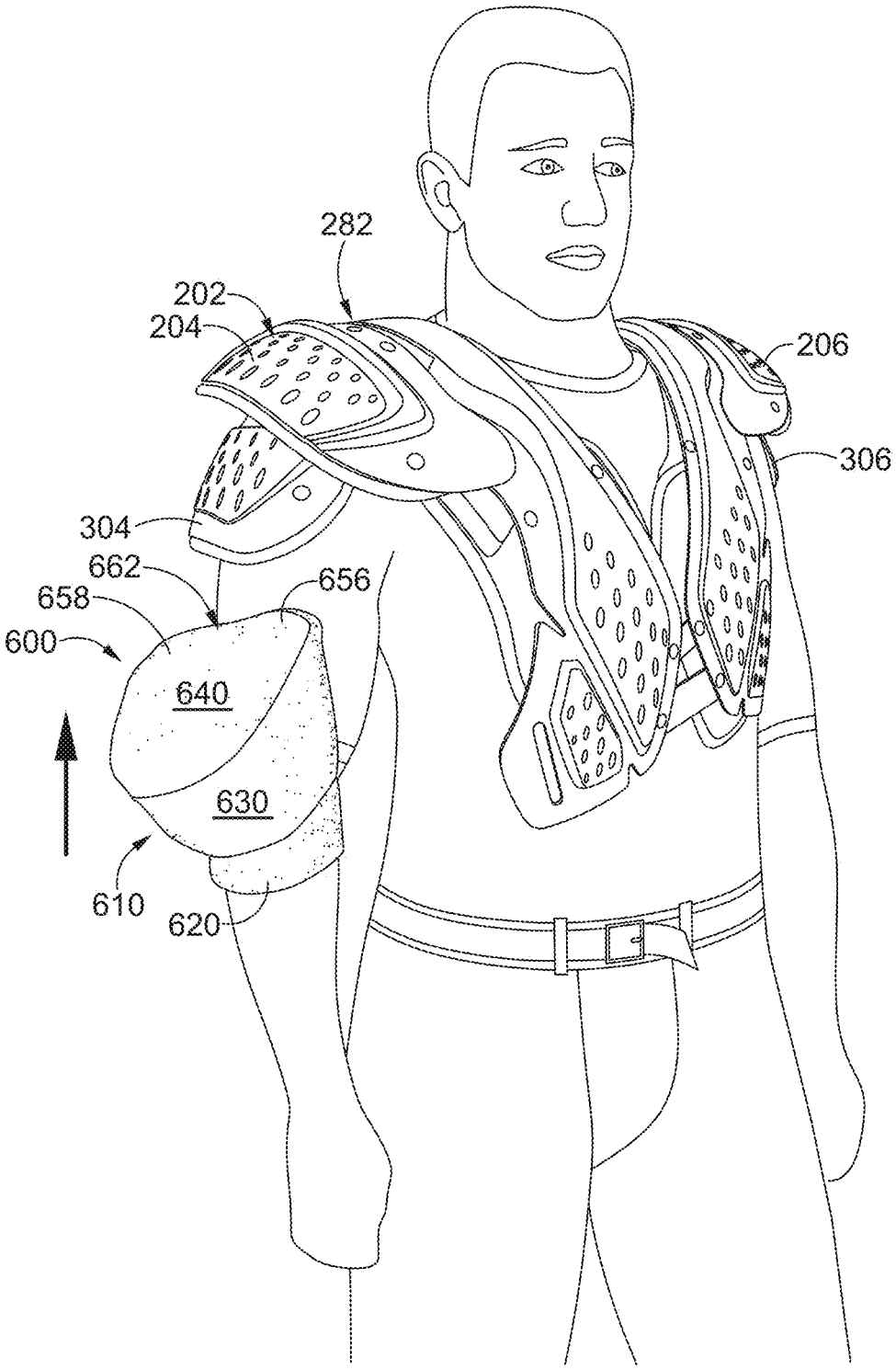

Turning to FIGS. 14A-14B, a method of donning the discrete shoulder sleeve 600 with other components of the shoulder-pad system 100 is illustrated. Because the discrete shoulder sleeve 600 may be detached from other upper-body garment components of the shoulder-pad system 100, such as securing garment 500 or base-layer garment 400, each discrete shoulder sleeve 600 (i.e., 600A and 600B) may be donned separately from each other and from other components of the shoulder-pad system 100. In accordance with the method shown, a set of shoulder pads may be placed onto the shoulders of the athlete. The set of shoulder pads may include at least a left-side shoulder assembly 222 generally corresponding to the left shoulder of the wearer and a right-side shoulder assembly 220 generally corresponding to the right shoulder of the wearer. Each shoulder assembly may include an epaulette, so that the left shoulder assembly 222 includes a left epaulette 206 while the right shoulder assembly 220 includes a right epaulette 204. The set of shoulder pads may also include an anterior plate assembly 207 and a posterior assembly 211.

In some aspects, the left-side shoulder assembly 222 and the right-side shoulder assembly 220 each further include a shoulder cap 306 and 304, respectively. As it depicted in FIG. 14A, the shoulder caps 304 and 306 may be a part of one component (e.g., the impact-attenuation sub-layer 300 in FIG. 4) that is separate from the component (e.g., the impact-plate assembly 200 in FIG. 4) that includes the epaulettes 204 and 206. In other aspects, the shoulder caps 304 and 306 and the epaulettes 204 and 206 are part of a single component. Regardless of whether they are separate as shown or part of the same component, the epaulettes 204 and 206 and the shoulder caps 304 and 306 together may form the right-side shoulder assembly and the left-side shoulder assembly, respectively. Accordingly, both may be placed on the shoulders of the wearer, as shown in FIG. 14A.

Continuing to FIG. 14B, the shoulder sleeve 600 may be affixed to the right epaulette 204. To don the discrete shoulder sleeve 600, the wearer may insert his or her right arm through the arm-receiving hole 660, into the cavity 652 of the shoulder pocket 610, and then through the cuff 620. The cuff 620 may then be slid up the wearer's arm. In alternative aspects, the cuff 620 may be wrapped around the wearer's arm, and two ends of the cuff 620 may be coupled by a releasable coupling mechanism.

The shoulder pocket 610 may be placed around the right epaulette 204 and, in some aspects, the right shoulder cap 304. The epaulette attachment means may be used to couple the shoulder pocket 610 to the right epaulette 204. For example, the right epaulette 204 may be inserted into the epaulette-receiving slot 654, with the partial medial side panel 638 wrapping around at least part of the protruding edge 282 of the right epaulette 204. In alternative aspects, coupling the shoulder pocket 610 to the right epaulette 204 via the epaulette attachment mechanism may include using any of the coupling mechanisms identified above with respect to the epaulette attachment mechanism, such as coupling one or more snap fastener components on the shoulder pocket 610 to corresponding snap fastener components on the epaulette 206 or using bands within the cavity 652.

In aspects including the shoulder caps 304 and 306, affixing the discrete shoulder sleeve 600 over the right epaulette 204 includes also affixing the discrete shoulder sleeve 600 over the right shoulder cap 304 as the right shoulder cap 304 may be generally positioned inferior to the right epaulette 204 when worn. When the discrete shoulder sleeve 600 is affixed to the right epaulette 204, the right epaulette 204 may be layered at least partially between the discrete shoulder sleeve 600 and the right shoulder cap 304.

Though not shown, a discrete shoulder sleeve may also be affixed to a left epaulette (such as 206) and, in some aspects, over a left shoulder cap (such as 306) in the same manner as described with respect to the right side. Though affixing the discrete shoulder sleeve 600 on the right side has been discussed first, the order in which the left-side and right-side discrete shoulder sleeves are attached is not a necessary part of this method.

In other aspects, the system 100 may include other discrete sleeves or covers that are configured to encase one or more plates of the impact-plate assembly 200. For example, an anterior-plate encasement may include one or more panels that fit around, and releasably attach to, the anterior-plate assembly 207. The anterior-plate encasement might include a single encasement that covers both the right and left portions 208 and 210, or the anterior-plate encasement may include discrete left and right encasings that cover the right and left portions independently of one another. Similar to the sleeve 600, the encasement might include a top panel that fits over the outward-facing surface of the anterior-plate assembly and one or more side panels, flanges, or other attachment mechanisms that wrap around, and releasably attach to the anterior-plate assembly. Among other things, the encasement may help to retain the anterior-plate assembly in a particular position, relative to the athlete or to other components of the system 100. In addition, the encasement may include a padding component (similar to panel 670) that provides a protective layer across the outward-facing surface of the anterior-plate assembly. Furthermore, the encasement may function to replace a jersey or uniform, and as such, the encasement may include player-identifying indicia, team logos, and the like. Although an anterior-plate encasement has been described, other aspects may include additional or alternative encasements, such as a posterior-plate encasement and shoulder-assembly encasements.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This principle is contemplated by and is within the scope of the claims. Because many possible embodiments may be made of the invention without departing from the scope thereof, it is to be understood that all matter herein set forth or shown in the accompanying drawings is to be interpreted as illustrative and not in a limiting sense.

The invention claimed is:

1. A shoulder-sleeve garment comprising:

a cuff including a band of textile forming a tubular body;

a shoulder pocket coupled to the cuff, the shoulder pocket including one or more textile panels coupled to one another to form a cavity, the one or more textile panels comprising a top panel having a top-panel medial portion and a side panel having a side-panel medial portion that is attached to the top-panel medial portion; and an epaulette-attachment mechanism attached to the shoulder pocket, the epaulette-attachment mechanism being releasably attachable to an epaulette of a shoulder-pad system, wherein the cavity is configured to receive the epaulette and wherein the side-panel medial portion is configured to be positioned medially relative to the epaulette when the epaulette is positioned within the cavity.

2. The shoulder-sleeve garment of claim 1, wherein the cuff includes a cuff medial portion, a cuff lateral portion, a cuff posterior portion, and a cuff anterior portion; and wherein the side panel of the shoulder pocket is attached to the cuff, the side panel further having a side-panel anterior portion attached to the cuff anterior portion, a side-panel lateral portion attached to the cuff lateral portion, and a side- panel posterior portion attached to the cuff posterior portion.

3. The shoulder-sleeve garment of claim 2, wherein at least a portion of the cuff medial portion is detached from the side panel.

4. The shoulder-sleeve garment claim 2, wherein the top panel further includes a top-panel anterior portion attached to the side-panel anterior portion, a top-panel lateral portion attached to the side-panel lateral portion, and a top-panel posterior portion attached to the side-panel posterior portion.

5. The shoulder-sleeve garment of claim 4, wherein the top-panel medial portion, the side-panel anterior portion, the side-panel posterior portion, the side- panel medial portion, and the at least a portion of the cuff medial portion form a perimeter edge around an arm-receiving hole.

6. The shoulder-sleeve garment of claim 1, wherein the cavity is configured to receive the epaulette and a shoulder cap that is layered at least partially inferior to the epaulette.

7. The shoulder-sleeve garment of claim 1, wherein the top panel includes a cushion element.

8. A shoulder-pad system comprising:

a set of shoulder pads including an anterior plate assembly, a posterior plate assembly, a left-side shoulder assembly, and a right-side shoulder assembly, each of the left-side shoulder assembly and the right-side shoulder assembly comprising:

an epaulette having a epaulette profile; and a discrete shoulder sleeve that is removably attachable to the epaulette and that comprises:

an epaulette-attachment mechanism that releasably attaches to the epaulette;

a shoulder pocket coupled with the epaulette-attachment mechanism and including one or more textile panels coupled to one another to form a cavity, the one or more textile panels at least partially encasing the epaulette when the epaulette is positioned in the cavity, the one or more textile panels comprising a top panel having a top-panel medial portion and a side panel having a side-panel medial portion that is attached to the top-panel medial portion, the side-panel medial portion being positioned medially relative to the epaulette when the epaulette is positioned in the cavity, and a cuff coupled to the shoulder pocket and including a band of textile forming a tubular body.

9. The shoulder-pad system of claim 8, wherein the top panel includes a panel shape that at least partially corresponds with the epaulette profile.

10. The shoulder-pad system of claim 9, wherein the epaulette profile includes at least one protruding edge, and wherein the top panel includes an anterior edge, a posterior edge, a lateral edge, and a medial edge; the medial edge including at least two concave portions and at least one protruding portion having a convex curvature, the at least one protruding portion aligning with the at least one protruding edge of the epaulette profile when the epaulette is positioned within the cavity.

11. The shoulder-pad system of claim 10, wherein the top panel further includes a top-panel anterior portion, a top-panel lateral portion, and a top-panel posterior portion, and wherein the side-panel medial portion and the medial edge of the top panel form an epaulette-receiving slot comprising at least part of the epaulette-attachment mechanism, the epaulette-receiving slot being positioned at a transition of the top panel from the top-panel medial portion to the top-panel anterior portion.

12. The shoulder-pad system of claim 10, wherein the top panel further includes a top-panel anterior portion, a top-panel lateral portion, and a top-panel posterior portion, and wherein the side-panel medial portion and the medial edge of the top panel form an epaulette-receiving slot comprising at least part of the epaulette-attachment mechanism, the epaulette-receiving slot being positioned at a transition of the top panel from the top-panel medial portion to the top-panel posterior portion.

13. The shoulder-pad system of claim 8, wherein the discrete shoulder sleeve is detached from another upper-body garment that covers at least part of the anterior plate assembly and the posterior plate assembly.

14. The shoulder-pad system of claim 8, wherein each of the left-side shoulder assembly and the right-side shoulder assembly further comprise a shoulder cap that is not directly attached to the epaulette and that is layered at least partially inferiorly to the epaulette and wherein the shoulder pocket at least partially encases the shoulder cap and the epaulette when the shoulder cap is positioned in the cavity with the epaulette.

15. A method of donning a shoulder-pad system, the method comprising:

placing a set of shoulder pads onto shoulders of a wearer, the set of shoulder pads including an anterior plate assembly, a posterior-plate assembly, a left- side shoulder assembly including a left epaulette, and a right-side shoulder assembly including a right epaulette;

affixing a left-side discrete shoulder sleeve over the left epaulette, the left- side discrete shoulder sleeve comprising one or more textile panels coupled to one another to form a left-side cavity, the left-side discrete shoulder sleeve comprising a left-side shoulder pocket comprising a top panel having a top-panel medial portion and a side panel having a side-panel medial portion attached to the top- panel medial portion, wherein the side-panel medial portion is positioned medially relative to the left epaulette when the left epaulette is positioned within the left-side cavity; and affixing a right-side discrete shoulder sleeve over the right epaulette, the right-side discrete shoulder sleeve comprising one or more textile panels coupled to one another to form a right-side cavity, the right-side discrete shoulder sleeve comprising a right-side shoulder pocket comprising a top panel having a top-panel medial portion and a side panel having a side-panel medial portion attached to the top-panel medial portion, wherein the side-panel medial portion is positioned medially relative to the right epaulette when the right epaulette is positioned within the right-side cavity, the left-side discrete shoulder sleeve and the right-side discrete shoulder sleeve being detached from an upper-body garment that at least partially covers the anterior plate assembly and the posterior plate assembly.

16. The method of claim 15, wherein the left-side shoulder assembly includes a left shoulder cap and the right-side shoulder assembly includes a right shoulder cap; wherein affixing the left-side discrete shoulder sleeve over the left epaulette includes also affixing the left-side discrete shoulder sleeve over the left shoulder cap; and wherein affixing the right-side discrete shoulder sleeve over the right epaulette includes also affixing the right-side discrete shoulder sleeve over the right shoulder cap.

17. The method of claim 16 further comprising, layering the left epaulette at least partially between the left-side discrete shoulder sleeve and the left shoulder cap, and layering the right epaulette at least partially between the right-side discrete shoulder sleeve and the right shoulder cap.

18. The shoulder-sleeve garment of claim 1, wherein the top panel comprises an anterior edge, a lateral edge, a posterior edge and a medial edge, wherein a transition between the anterior edge and the medial edge and a transition between the posterior edge and the medial edge each comprise a rounded corner, wherein a first portion of the medial edge adjacent the transition between the anterior edge and the medial edge and a second portion of the medial edge adjacent the transition between the posterior edge and the medial edge each have a concave curvature.

19. The shoulder-sleeve garment of claim 18, wherein a middle portion of the medial edge of the top panel comprises a protruding edge that has a convex curvature.

20. The shoulder-pad system of claim 8, wherein the top panel includes a perimeter formed by an anterior edge, a posterior edge, a lateral edge, and a medial edge of the top panel, the perimeter of the top panel being aligned with a perimeter of the epaulette when the epaulette is positioned within the cavity.

* * * * *